US010648200B2

(12) United States Patent
Arlinghaus et al.

(10) Patent No.: US 10,648,200 B2
(45) Date of Patent: May 12, 2020

(54) EXIT DEVICE ASSEMBLY

(71) Applicant: Schlage Lock Company LLC, Carmel, IN (US)

(72) Inventors: Paul R. Arlinghaus, Fishers, IN (US); David M. Schacht, New Castle, IN (US); Michael D. Coleman, Noblesville, IN (US); Abdur Rahman Shareef, Carmel, IN (US); Matthew A. Phillips, Greenfield, IN (US); Marlin Austin, Speedway, IN (US)

(73) Assignee: Schlage Lock Company LLC, Carmel, IN (US)

( * ) Notice: Subject to any disclaimer, the term of this patent is extended or adjusted under 35 U.S.C. 154(b) by 359 days.

(21) Appl. No.: 15/443,282

(22) Filed: Feb. 27, 2017

(65) Prior Publication Data

US 2017/0167165 A1 Jun. 15, 2017

Related U.S. Application Data

(62) Division of application No. 13/593,041, filed on Aug. 23, 2012, now Pat. No. 9,580,944.
(Continued)

(51) Int. Cl.
*E05B 65/10* (2006.01)
*E05B 53/00* (2006.01)
(Continued)

(52) U.S. Cl.
CPC ..... *E05B 65/1006* (2013.01); *E05B 47/023* (2013.01); *E05B 53/005* (2013.01);
(Continued)

(58) Field of Classification Search
CPC .. E05B 53/003; E05B 65/1006; E05B 47/023; E05B 65/1046; E05B 79/20; E05C 9/00; E05C 9/063; E05C 9/1841
See application file for complete search history.

(56) References Cited

U.S. PATENT DOCUMENTS 2,098,776 A 11/1937 Edwards
2,136,061 A 11/1938 Steele
(Continued)

FOREIGN PATENT DOCUMENTS

CN 2433368 Y 6/2001
CN 201232498 Y 5/2009
(Continued)

OTHER PUBLICATIONS

Canadian Office Action; Canadian Intellectual Property Office; Canadian Patent Application No. 2,848,084; dated Aug. 2, 2018; 3 pages.
(Continued)

*Primary Examiner* — Mark A Williams
(74) *Attorney, Agent, or Firm* — Taft Stettinius & Hollister LLP

(57) ABSTRACT

An exit device assembly for use in association with a door having a top, a bottom and a generally vertical surface. The exit door assembly includes an exit device configured to be mounted on the surface of the door, the exit device including a manually movable member, a latch mechanism configured to be mounted adjacent one of the top and the bottom of the door, the latch mechanism including a latch movable between a locking position and a non-locking position, and a non-rigid device for causing movement of the latch in response to movement of the manually movable member.

22 Claims, 19 Drawing Sheets

Related U.S. Application Data

(60) Provisional application No. 61/638,350, filed on Apr. 25, 2012, provisional application No. 61/526,595, filed on Aug. 23, 2011.

(51) Int. Cl.
*E05B 63/14* (2006.01)
*E05B 47/02* (2006.01)
*E05C 3/16* (2006.01)

(52) U.S. Cl.
CPC ..... *E05B 63/143* (2013.01); *E05B 65/1046* (2013.01); *E05B 65/1053* (2013.01); *E05B 65/1093* (2013.01); *E05C 3/162* (2013.01); *Y10T 292/1045* (2015.04)

(56) References Cited

U.S. PATENT DOCUMENTS

| | | | | |
|---|---|---|---|---|
| 2,552,815 | A | 5/1951 | Roethel | |
| 3,563,585 | A | 2/1971 | Welch | |
| 3,614,145 | A | 10/1971 | Zawadzki | |
| 3,677,043 | A | 7/1972 | Cox | |
| 3,730,574 | A | 5/1973 | Zawadzki | |
| 3,875,772 | A | 4/1975 | Ebersman et al. | |
| 3,910,611 | A * | 10/1975 | Slovensky, Jr. | E05B 53/003 292/38 |
| 3,965,564 | A * | 6/1976 | Slovensky, Jr. | E05B 53/003 29/434 |
| 4,199,176 | A | 4/1980 | Kelly | |
| 4,328,985 | A | 5/1982 | Logan | |
| 4,344,647 | A | 8/1982 | Van Der Linden | |
| 4,351,552 | A | 9/1982 | Van Der Linden | |
| 4,470,625 | A | 9/1984 | Walsh et al. | |
| 4,545,606 | A | 10/1985 | Vodra | |
| 4,739,584 | A | 4/1988 | Zellman | |
| 4,819,976 | A | 4/1989 | Bert | |
| 5,011,199 | A | 4/1991 | Lowe et al. | |
| 5,067,757 | A | 11/1991 | Cohrs et al. | |
| 5,076,015 | A | 12/1991 | Manzalini | |
| 5,085,475 | A | 2/1992 | Austin et al. | |
| 5,169,185 | A | 12/1992 | Slaybaugh et al. | |
| 5,290,077 | A | 3/1994 | Fleming | |
| 5,372,394 | A | 12/1994 | Salter et al. | |
| 5,509,233 | A * | 4/1996 | Peterson | E05B 53/003 49/139 |
| 5,582,472 | A | 12/1996 | Lyons et al. | |
| 5,590,917 | A * | 1/1997 | Brooks | E05B 15/004 292/21 |
| 5,688,002 | A | 11/1997 | Riley et al. | |
| 5,702,134 | A | 12/1997 | Hsieh | |
| 6,006,560 | A | 12/1999 | DeVries | |
| 6,106,032 | A | 8/2000 | Och | |
| 6,357,805 | B1 * | 3/2002 | Hebda | E05B 53/003 292/1 |
| 6,485,068 | B1 | 11/2002 | Sauve | |
| 6,634,681 | B1 | 10/2003 | Redden | |
| 6,715,225 | B1 | 4/2004 | Frolov et al. | |
| 6,769,723 | B2 | 8/2004 | Cohrs, Jr. et al. | |
| 6,779,819 | B2 | 8/2004 | Surko, Jr. | |
| 6,820,905 | B1 | 11/2004 | Haeck et al. | |
| 6,962,374 | B2 | 11/2005 | Belloma et al. | |
| 7,000,954 | B2 | 2/2006 | Cohrs, Jr. et al. | |
| 7,503,597 | B2 | 3/2009 | Cohrs, Jr. et al. | |
| 7,918,487 | B2 * | 4/2011 | Lin | E05B 65/1006 292/92 |
| 10,208,507 | B2 * | 2/2019 | Kondi | E05B 53/003 |
| 2007/0273158 | A1 | 11/2007 | Berger | |
| 2013/0154283 | A1 * | 6/2013 | Arlinghaus | E05B 47/023 292/214 |
| 2016/0002954 | A1 * | 1/2016 | Ali | E05B 63/18 292/336.3 |

FOREIGN PATENT DOCUMENTS

| | | | |
|---|---|---|---|
| CN | 201301650 | Y | 9/2009 |
| DE | 4322622 | C1 | 2/1995 |
| EP | 0009308 | A1 | 4/1980 |
| EP | 0065418 | A2 | 11/1982 |
| EP | 0259112 | A2 | 3/1988 |
| GB | 2311091 | A | 9/1997 |
| GB | 2330616 | A | 4/1999 |
| WO | 2000073607 | A1 | 12/2000 |
| WO | 2009087692 | A2 | 7/2009 |
| WO | 2010076830 | A1 | 7/2010 |
| WO | 2010113191 | A1 | 10/2010 |
| WO | 2011031542 | A1 | 3/2011 |

OTHER PUBLICATIONS

International Search Report; International Patent Application No. PCT/US2012/052066; dated Nov. 16, 2012; 2 pages.

Written Opinion of the International Searching Authority; International Patent Application No. PCT/US2012/052066; dated Nov. 16, 2012; 10 pages.

Canadian First Office Action; Canadian intellectual Property Office; Canadian Patent Application No. 2,848,084; dated Mar. 9, 2016; 3 pages.

Chinese Search Report; Chinese Patent Office; Chinese Patent Application No. 201280051872.X; dated Jun. 11, 2015; 4 pages.

Chinese First Office Action; Chinese Patent Office; Chinese Patent Application No. 201280051872.X, dated Jun. 26, 2015; 21 pages.

Chinese Office Action; State Intellectual Property Office of People's Republic of China; Chinese Patent Application No. 201280051872.X; dated Nov. 22, 2016; 23 pages.

Chinese Search Report; National Intellectual Property Administration, P.R. China; Chinese Patent Application No. 201710666374.0; dated Nov. 27, 2018; 4 pages.

Chinese Office Action; National Intellectual Property Administration, P.R. China; Chinese Patent Application No. 201710666374.0; dated Dec. 5, 2018; 9 pages.

Canadian Office Action; Canadian Intellectual Property Office; Canadian Patent Application No. 3,004,573; dated Aug. 27, 2019; 3 pages.

Chinese Search Report (Second); National Intellectual Property Administration, P.R. China; Chinese Patent Application No. 201710666374.0; dated Jul. 5, 2019; 4 pages.

Chinese Office Action (Second); National Intellectual Property Administration, P.R. China; Chinese Patent Application No. 201710666374.0; dated Jul. 16, 2019; 11 pages.

* cited by examiner

EXIT DEVICE ASSEMBLY

CROSS REFERENCE TO RELATED APPLICATIONS

The present application is a divisional of U.S. patent application Ser. No. 13/593,041 filed Aug. 23, 2012, which claims the benefit of U.S. Provisional Patent Application Ser. No. 61/638,350 filed Apr. 25, 2012, and which also claims the benefit of U.S. Provisional Patent Application Ser. No. 61/526,595 filed Aug. 23, 2011, the contents of each of these applications hereby incorporated herein by reference in their entirety.

BACKGROUND

The present invention generally relates to exit devices for use in association with doors. A known exit device assembly comprises an exit device mounted on the door, an upper latch mechanism mounted adjacent the top of the door, and a lower latch mechanism mounted adjacent the bottom of the door. The exit device may have a pushpad or crossbar. The upper latch mechanism may be engageable with a strike on the door frame above the door, and the lower latch mechanism may be engageable with a recess in the floor below the door. The exit device may be operably connected to the latch mechanisms by rigid rods.

SUMMARY

In one form, the present invention provides an exit device assembly for use with a door having a top, a bottom and a generally vertical surface, the assembly comprising an exit device configured to be mounted on the surface of the door, the exit device including a manually movable member, a latch mechanism configured to be mounted adjacent one of the top and the bottom of the door, the latch mechanism including a latch movable between a locking position and a non-locking position, and a non-rigid device for causing movement of the latch in response to movement of the manually movable member.

In another form, the present invention provides an exit device assembly for use with a door having a top, a bottom and a generally vertical surface, the assembly comprising an exit device configured to be mounted on the surface of the door, the exit device including a manually movable member, a first latch mechanism configured to be mounted adjacent one of the top and the bottom of the door, the first latch mechanism including a first latch movable between a locking position and a non-locking position, a mechanism for causing movement of the first latch in response to movement of the manually movable member, a second latch mechanism configured to be mounted adjacent the other of the top and the bottom of the door, the second latch mechanism including a second latch movable between a locking position and a non-locking position, and a non-rigid device connected between the first latch mechanism and the second latch mechanism for actuating the second latch mechanism.

In another form, the present invention provides a latch mechanism comprising a latch movable between a locking position and a non-locking position, and an anti-bounce arrangement.

In another form, the present invention provides an exit device assembly for use with a door having a top, a bottom and a generally vertical surface, the assembly comprising an exit device configured to be mounted on the surface of the door, the exit device including a manually movable member, a latch mechanism configured to be mounted adjacent one of the top and the bottom of the door, the latch mechanism including a latch movable between a locking position and a non-locking position, and the latch mechanism including an anti-bounce arrangement, and an actuating device for causing movement of the latch in response to movement of the manually movable member.

In another form, the present invention provides an exit device assembly for use with a door having a top, a bottom and a generally vertical surface, the assembly comprising an exit device configured to be mounted on the surface of the door, the exit device including a manually movable member, a latch mechanism configured to be mounted adjacent one of the top and the bottom of the door, the latch mechanism including a latch movable between a locking position and a non-locking position, a cable for causing movement of the latch in response to movement of the manually movable member, and a slack removal mechanism connected to the cable.

In another form, the present invention provides an exit device assembly suitable for use with a door disposed within a frame and an exit device. The exit device assembly includes a first latch mechanism having a movable portion and a fixed portion attachable to the door, the movable portion including a latch that selectively engages the frame to maintain the door in a closed position and disengages from the frame to allow movement of the door with respect to the frame. A slide member has a movable portion and a fixed portion attachable to the door such that a distance between the slide member and the first latch mechanism is substantially fixed. An enclosed cable includes an outer sheath and an inner cable. A first end of the outer sheath is attached to the fixed portion of the first latch mechanism, and a second end of the sheath is attached to the fixed portion of the slide member. A first end of the inner cable is attached to the movable portion of the first latch mechanism, and a second end of the inner cable is attached to the movable portion of the slide member such that movement of the movable portion of the slide member produces a corresponding movement of the latch.

In another form, the present invention provides a method of latching a door to a frame. The method includes providing a latch mechanism having a fixed portion that is attachable to the door and a movable portion having a latch that selectively engages the frame and providing a slide mechanism having a fixed portion that is attachable to the door and a movable portion movable between a first position and a second position. The method also includes connecting a first end of a cable to the latch mechanism and a second end of the cable to the slide mechanism. The cable includes an outer sheath that attaches to the fixed portion of the latch mechanism and the slide mechanism, and an inner cable that attaches to the movable portion of the latch mechanism and the slide mechanism. The method further includes moving the movable portion of the slide mechanism to the second position to move the movable portion of the latch mechanism to disengage the latch from the frame, and biasing the latch into engagement with the frame when the movable portion of the slide mechanism returns to the first position.

Other aspects of the present invention will become apparent by consideration of the detailed description and accompanying drawings.

Before any embodiments of the present invention are explained in detail, it is to be understood that the present invention is not limited in its application to the details of construction and the arrangement of components set forth in the following description or illustrated in the following drawings. The present invention is capable of other embodiments and of being practiced or of being carried out in various ways.

DESCRIPTION OF THE ILLUSTRATED EMBODIMENTS

Figure 1:
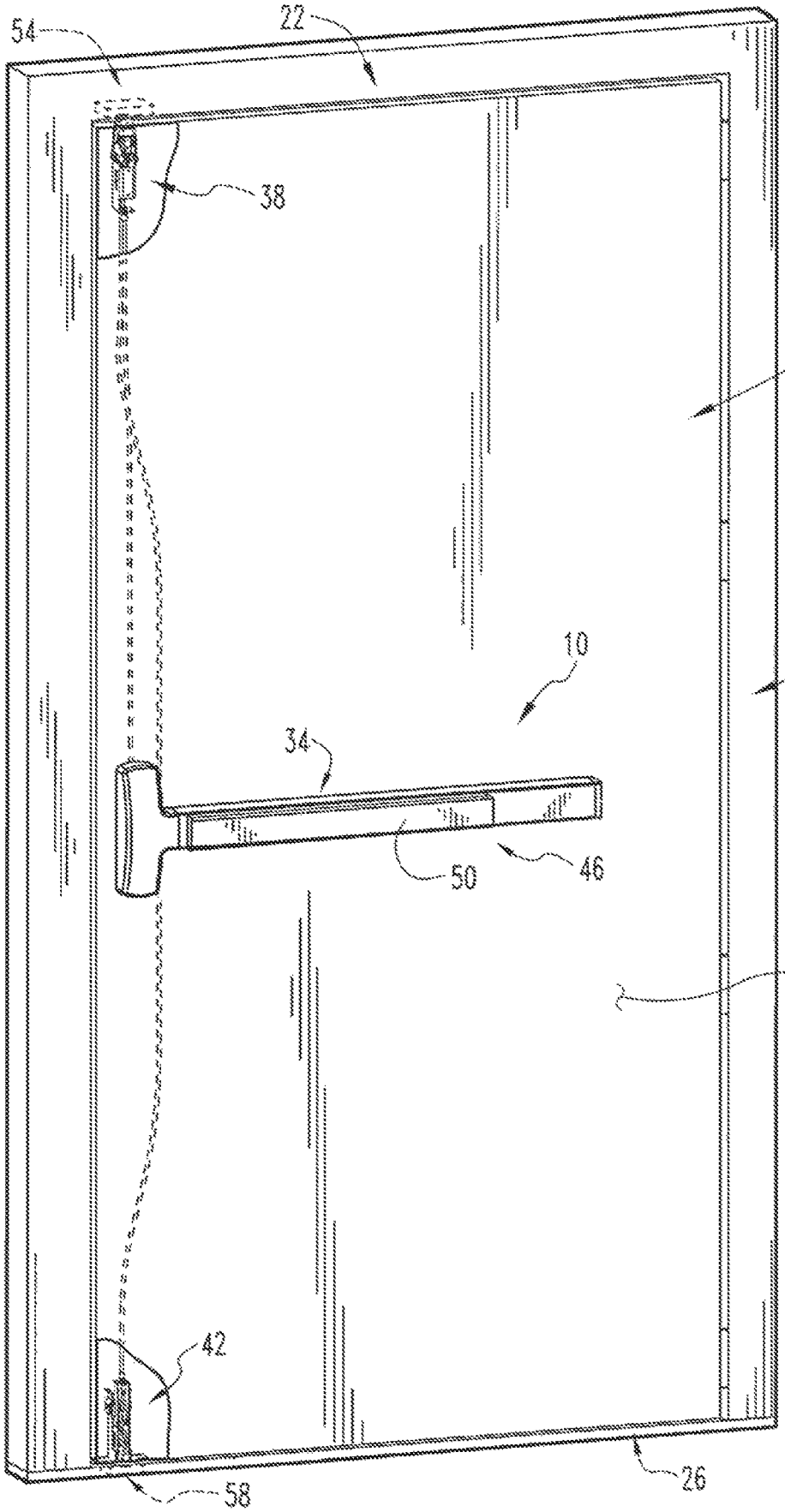
FIG. 1 is a perspective view of a door with an exit device assembly.

Referring to FIG. 1, illustrated therein is one embodiment of an exit device assembly 10 operably mounted on a door 14. The door 14 is mounted in a door frame 18 and has a top 22, a bottom 26 and a generally vertical interior surface 30. The exit device assembly 10 includes an exit device 34 mounted on the interior surface 30 of the door 14, an upper latch mechanism 38 mounted to the door 14 adjacent the top 22, and a lower latch mechanism 42 mounted to the door 14 adjacent the bottom 26.

In one aspect of the invention, the exit device 34 is mounted in a recessed or partially recessed position within the door 14. In another aspect, the exit device 34 includes a pushpad mechanism 46 having a manually movable member or pushpad 50. However, it should be understood that other types of exit devices and manually movable members can be used in association with the present invention. The upper latch mechanism 38 is engageable with a strike 54 on the door frame 18 above the door 14, and the lower latch mechanism 42 is engageable with a recess 58 in the floor or door frame 18 below the door 15. However, it should be understood that the present invention further contemplates other embodiments with a single latch mechanism, and embodiments with one or mare latch mechanisms located at locations other than at the top 22 of the door 14 and/or the bottom 26 of the door 14.

Figure 5:
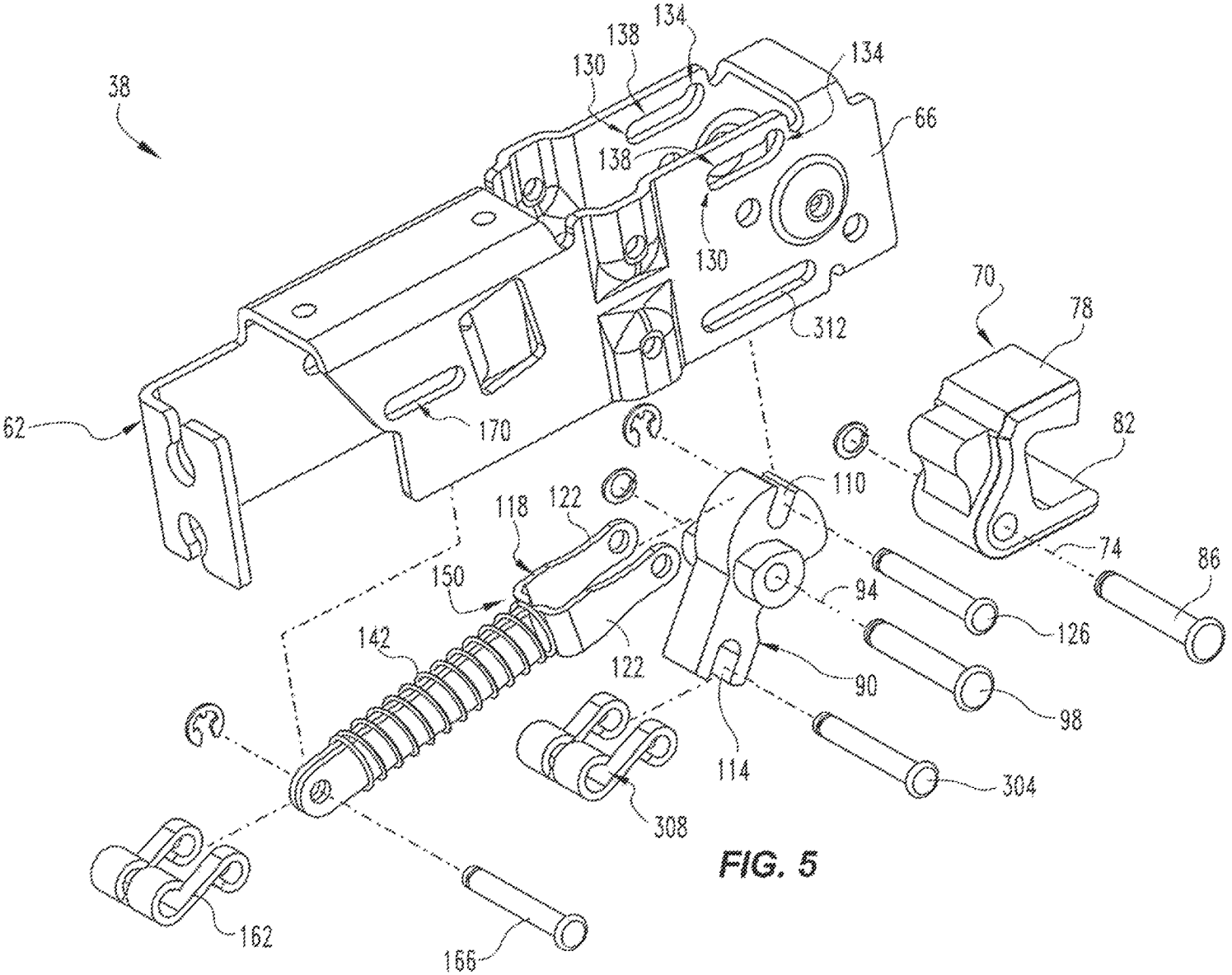
FIG. 5 is an exploded perspective view of the upper latch mechanism.
Figure 6:
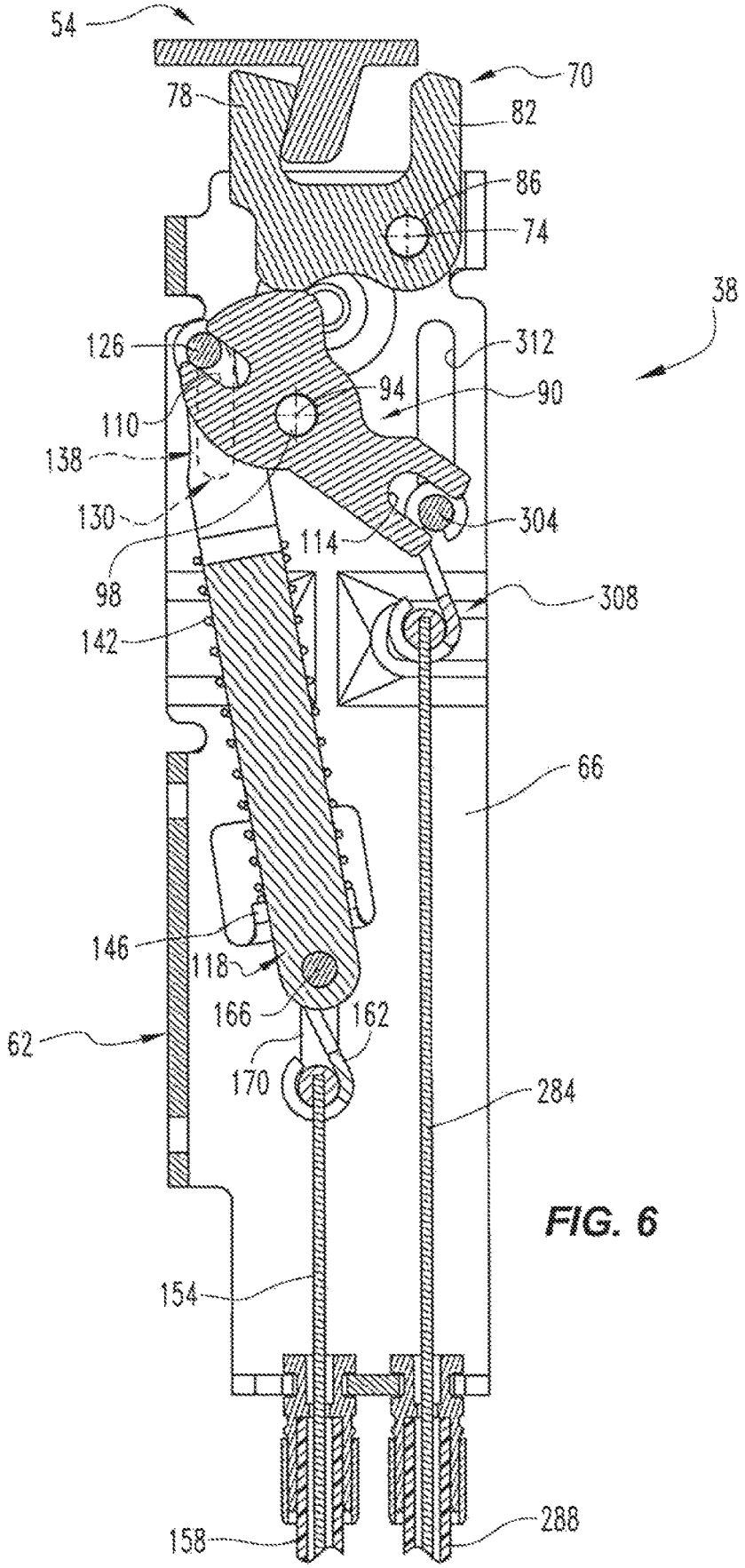
FIG. 6 is a vertical sectional view of the upper latch mechanism with the latch in a locking position.
Figure 7:
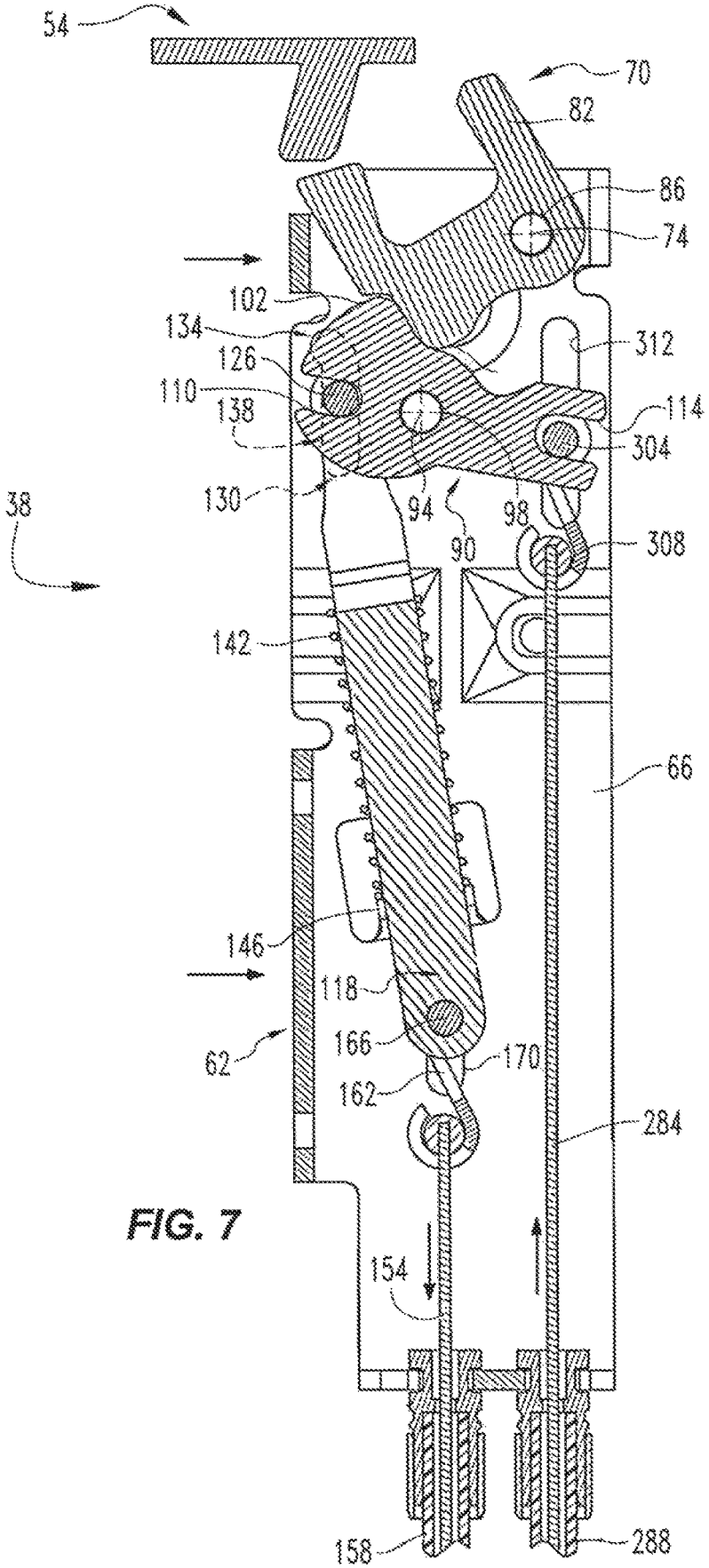
FIG. 7 is a vertical sectional view of the upper latch mechanism with the door opening and the latch in a non-locking position.

Referring to FIGS. 3-7, in the illustrated embodiment, the upper latch mechanism 38 includes a base member or bracket 62 secured to the door 14. The bracket 62 is generally V-shaped in cross section and includes spaced, parallel walls 66. An upper latch 70 is mounted to the bracket 62 for pivotable movement relative thereto about a horizontal axis 74 between a locking position (FIG. 6) and a non-locking position (FIG. 7). The upper latch 70 is preferably formed as a casting for strength. In the illustrated embodiment, the upper latch 70 is U-shaped and has spaced legs 78 and 82 extending away from the horizontal axis 74. The upper latch 70 is mounted on a pin 86 that extends along the horizontal axis 74 between the walls 66 of the bracket 62. When the door is closed and the upper latch 70 is in the locking position (FIG. 6), the legs 78 and 82 are on opposite sides of the strike 54. When the upper latch 70 is maintained in the locking position, as will be described in further detail below, engagement of the strike 54 by the leg 78 prevents opening of the door.

The upper latch mechanism 38 also includes a blocking member 90 mounted on the bracket 62 for pivotable movement relative thereto about a horizontal axis 94 between a blocking position (FIG. 6) and a non-blocking position (FIG. 7). The blocking member 90 is preferably also formed as a casting for strength. The blocking member 90 is mounted on a pin 98 that extends along the horizontal axis 94 between the bracket walls 66. When the blocking member 90 is in the blocking position (FIG. 6), the blocking member engages the upper latch 70 and holds the upper latch 70 in the locking position. Stated another way, when the blocking member 90 is in the blocking position, the blocking member prevents movement of the upper latch 70 from the locking position or toward the non-locking position (i.e., prevents movement in a counterclockwise direction in FIG. 6). Specifically, as shown in FIG. 7, the blocking member 90 has a surface 102 that engages a corresponding surface 106 on the upper latch 70 when the blocking member 90 is in the blocking position. When the blocking member 90 pivots to the non-blocking position (FIG. 7), the surfaces 102 and 106 no longer engage, and the upper latch 70 is free to pivot toward the non-locking position, which the upper latch 70 will do either due to engagement with the strike 54 as the door is opened or due to gravity.

Figure 3:
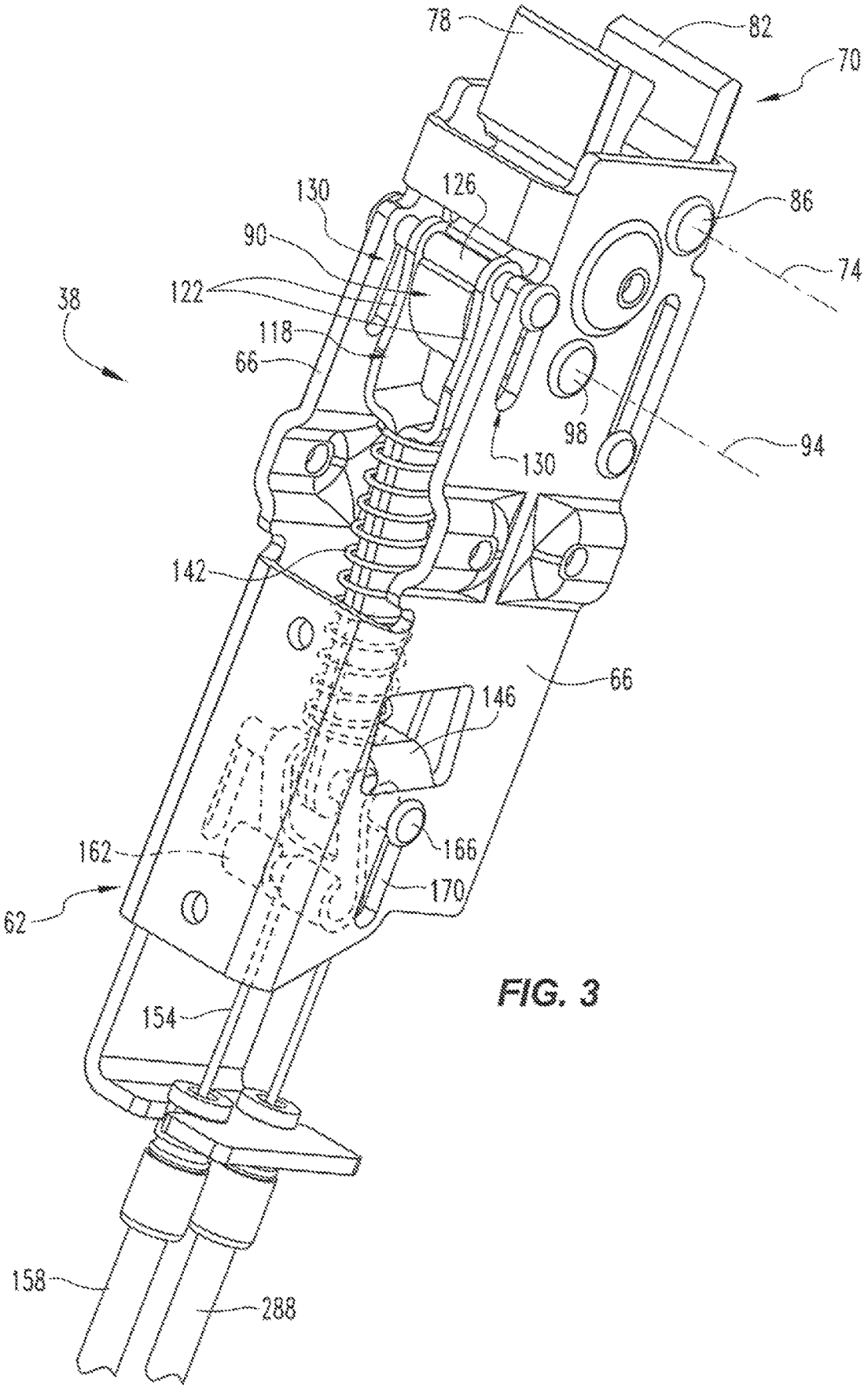
FIG. 3 is a perspective view of the upper latch mechanism of the exit device assembly.

The blocking member 90 includes diametrically opposed slots 110 and 114, both extending radially from the axis 94 and opening in opposite directions. The upper latch mechanism 38 also includes a rod 118 operably connected to the blocking member 90. As shown in FIG. 5, the upper end of the rod 118 has spaced arms 122 defining a yoke therebetween. As shown in FIG. 3, a pin 126 arranged generally parallel to the horizontal axis 94 is mounted on the upper end of the rod 118 (i.e., extending between the arms 122), and the pin 126 is positioned in and extends through the slot 110 in the blocking member 90. The pin 126 also travels in a pair of slots 130 defined in the bracket walls 66 of the bracket 62. In other words, movement of the pin 126 is confined to the slots 130.

In the illustrated embodiment, each slot 130 has an upper portion 134 (FIGS. 5 and 7) that extends radially from the horizontal axis 94, and a lower portion 138 (FIGS. 5 and 6) that extends vertically and non-radially from the horizontal axis 94. When the pin 126 is displaced along the upper portion 134 of the slot 130, the pin 126 moves only radially relative to the horizontal axis 94. Because the upper portion 134 of the slot 110 in the blocking member 90 is radial, movement of the pin 126 does not pivot the blocking member 90. However, when the pin 126 is displaced along the lower portion 138 of the slot 130, the pin engages the walls of the lower portion 138 of the slot 110 in the blocking member 90 and correspondingly pivots the blocking member 90. The pin 126 is movable between an upper position (FIG. 6) and a lower position (FIG. 7). When the pin 126 is in the upper position, the pin 126 is positioned in the upper portion 134 of each slot 130 and the blocking member 90 is positioned in the blocking position. During initial movement of the pin 126 downward or away from the upper position, the pin 126 remains in the upper portion 134 of each slot 130 and the blocking member 90 does not pivot. However, as the pin 126 is displaced into the lower portion 138 of each slot 130 toward the lower position, the pin 126 engages the blocking member 90 and pivots the blocking member 90 to the non-blocking position.

In one embodiment, the pin 126 moves with the rod 118, and the rod 118 is biased in an upward direction or in a direction which moves the pin 126 to its upper position. The rod 118 is biased upwardly by a compression spring 142 extending between the bracket 62 and the rod 118. Specifically, the lower end of the spring 142 engages tabs 146 extending inwardly from the bracket walls 66, and the upper end of the spring engages a shoulder 150 (FIG. 5) on the rod 118. The pin 126 moves in a downward direction, or toward its lower position, when the rod 118 is displaced downwardly against the force of the spring 142. In one embodiment, movement of the rod 118 is controlled by a cable 154 connected to the lower end of the rod 118. In the illustrated embodiment, the cable 154 is an enclosed or Bowden cable surrounded by a sheath or conduit 158, with the upper end of the sheath 158 fixed to the lower end of the bracket 62 by a coupler device. The sheath 158 serves to protect the cable 154 from damage or wear, and also acts as a ground for the cable system. The upper end of the cable 154 is also fixed/anchored to the lower end of the rod 118 by a yoke 162 and a pin 166 (FIGS. 6 and 7). The pin 166 extends generally parallel to the horizontal axis 94 and travels in vertical slots 170 defined in the bracket walls 66. As should be appreciated, fixation of the sheath 158 to the bracket 62 and connection of the cable 154 to the rod 118 of the upper latch mechanism 38 eliminates the need to attach the cable 154 or the sheath 158 directly to the door 14.

Figure 2:
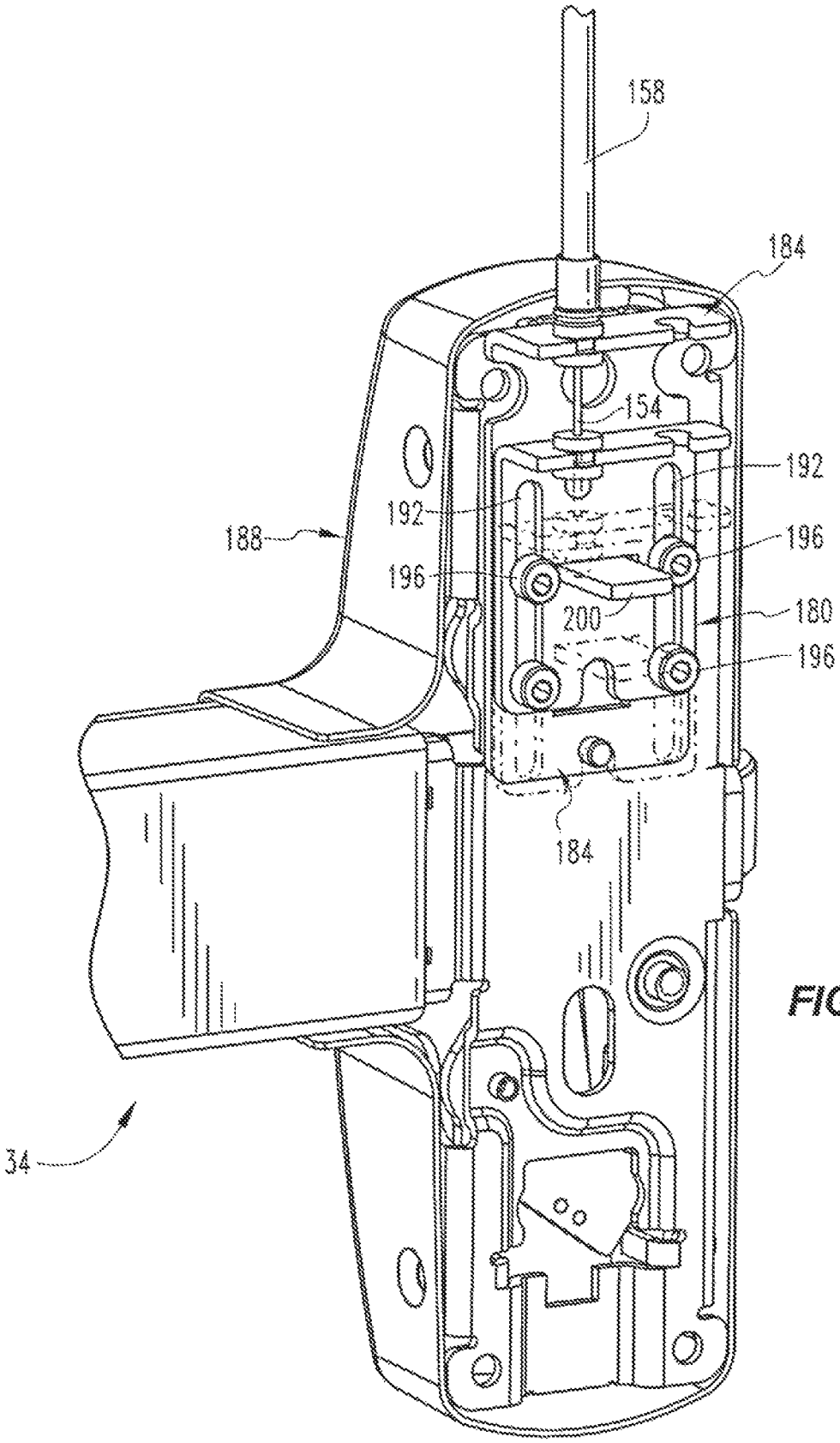
FIG. 2 is an enlarged perspective view of a portion of the exit device assembly.

Referring to FIG. 2, in the illustrated embodiment, the lower end of the cable 154 is fixed to a slide member 180 mounted on the door for vertical movement between an upper position (shown in solid lines) and a lower position (shown in phantom lines). As also shown in FIG. 2, the slide member 180 is slidably mounted on a slide bracket 184 fixed to the centercase 188 of the exit device 34, which is in turn fixed to the door. Specifically, the slide member 180 includes parallel slots 192 that receive posts 196 extending from the slide bracket 184. The posts 196 can be provided as screws threaded into the bracket 184, with heads of the screws maintaining the slide member 180 in position. The sheath 158 surrounding the cable 154 is operably secured to the slide bracket 184. When the slide member 180 is in its upper position, the spring 142 holds the rod 118 in its upper position. When the slide member 180 is disclosed to its lower position, the cable 154 pulls the rod 118 to its lower position, which in turn pulls the blocking member 90 to the non-blocking position, thereby permitting the upper latch 70 to move to the non-locking position. It should be understood that the slide member 180 need not move vertically, but can alternatively move in any direction to exert a pulling force onto the cable 154. It should be appreciated that the slide member 180 allows the vertical system (i.e., the upper and latch mechanisms 38, 42 and the cable) to be installed on the door 14 independently from the exit device 34. This allows the door 14 to be shipped with the vertical system pre-installed, and also allows the vertical system to be adjusted and serviced independently of the exit device 34.

As should be appreciated, movement of the slide member 180 is controlled by actuation/de-actuation of the pushpad mechanism 46. As shown in FIG. 2, the centercase 188 of the pushpad mechanism has a tongue 200 that extends into a slot in the slide member 180. The tongue 200 moves downward and pulls the slide member 180 to its lower position when the pushpad 50 is pushed inward (i.e., toward the door) by a user opening the door 14. The tongue 200 is displaced in an upward direction when the pushpad 50 is released by the user. As should be appreciated, the pushpad mechanism 46 can use any known mechanism to move the tongue 200 in response to movement of the pushpad. Additionally, it should be understood that other mechanisms can be used to displace the slide member 180, and the slide member 180 can be mounted anywhere on the door. The exit device assembly 10 simply requires some type of mechanism to convert movement of the pushpad 50 into corresponding movement of the slide member 180.

Figure 10:
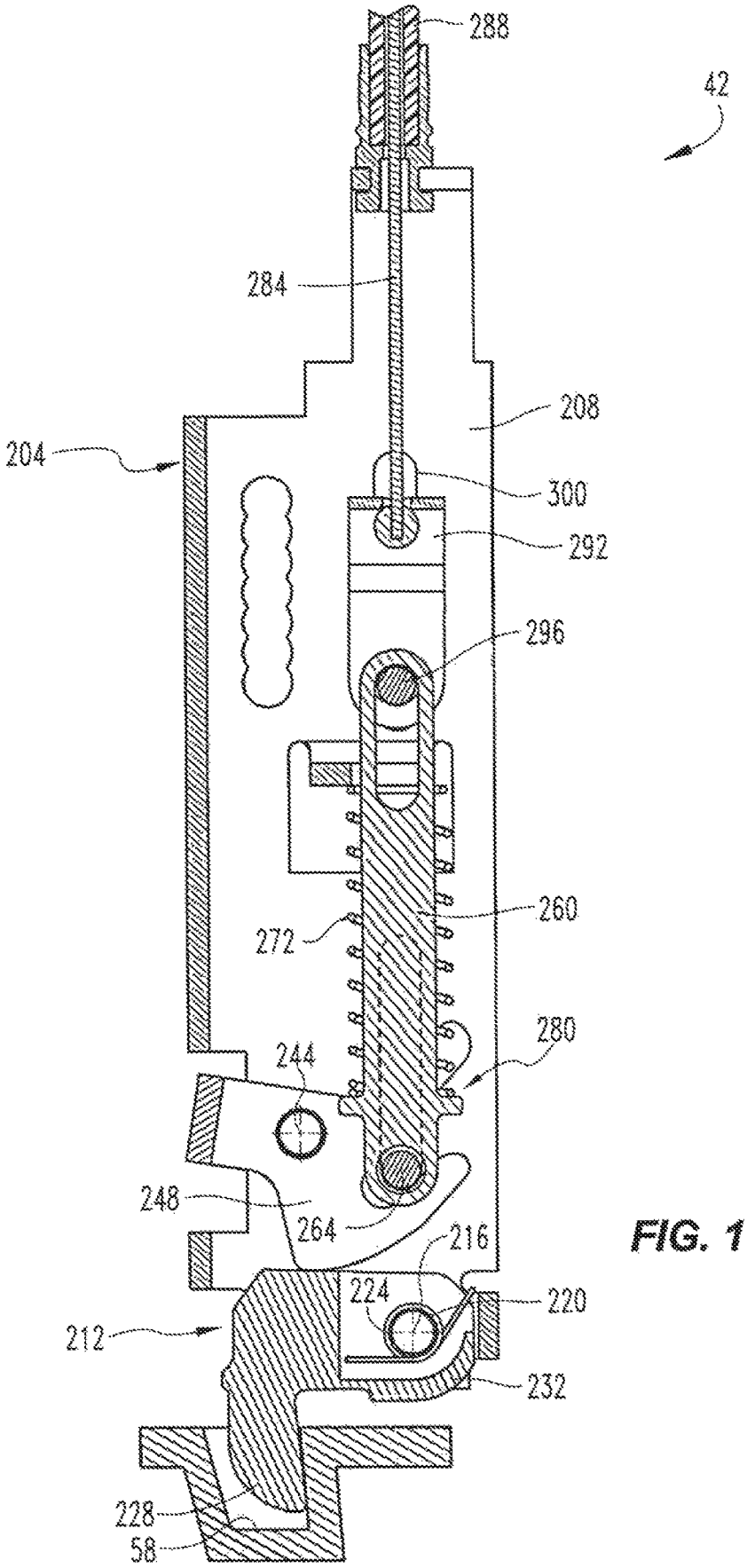
FIG. 10 is a vertical sectional view of the lower latch mechanism with the latch in a locking position.
Figure 11:
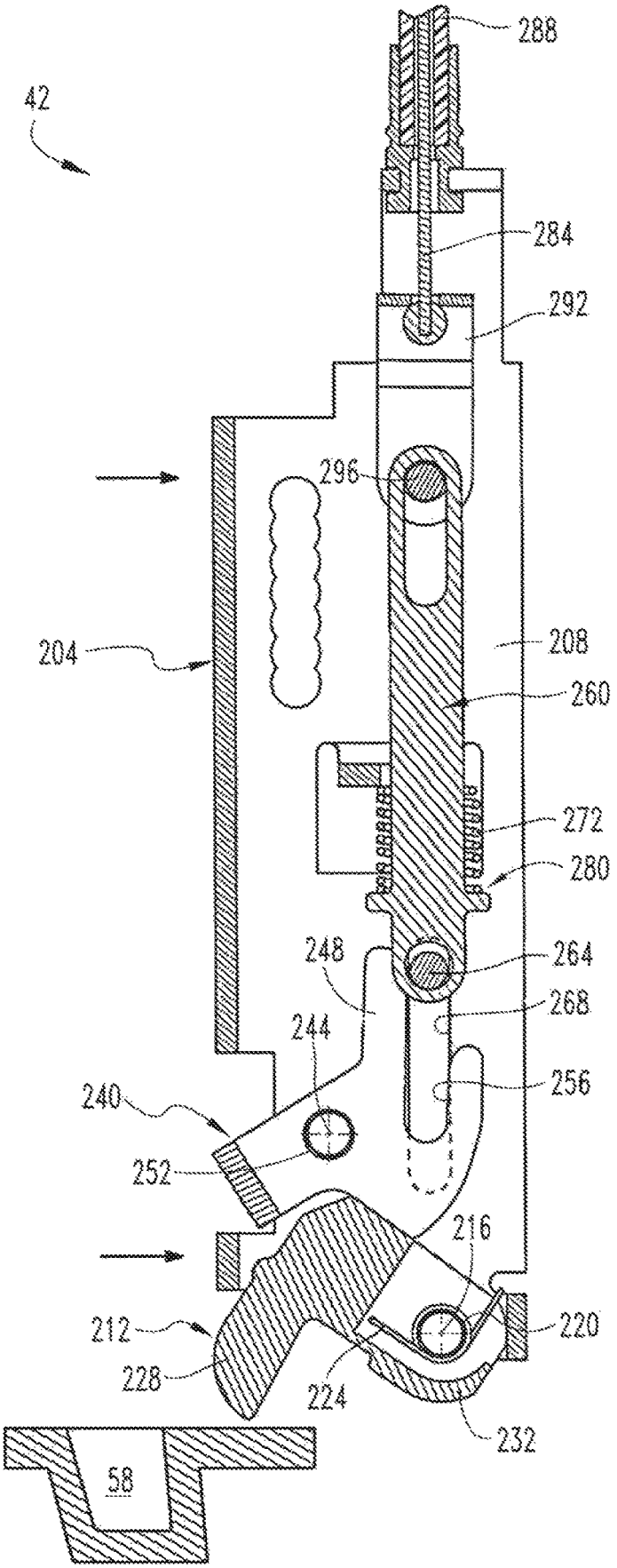
FIG. 11 is a vertical sectional view of the lower latch mechanism with the door opening and the latch in a non-locking position.

Referring to FIGS. 8-11, in the illustrated embodiment, the lower latch mechanism 42 includes a base member or bracket 204 secured to the door 14. The bracket 204 includes spaced apart parallel walls 208. A lower latch 212 is mounted on the bracket 204 for pivotable movement relative thereto about a horizontal axis 216 between a locking position (FIG. 10) and a non-locking position (FIG. 11). The lower latch 212 is mounted on a pin 220 that extends along the horizontal axis 216 between the bracket walls 208. A torsion spring 224 surrounding the pin 220 biases the lower latch 212 toward the non-locking position. In the illustrated embodiment, the lower latch 212 is generally L-shaped and has legs 228 and 232 that are arranged generally perpendicular or normal to one another. As shown in FIG. 10, when the door is closed and the latch 212 is in the locking position, the leg 228 extends into the recess 58 in the floor. When the lower latch 212 is held in the locking position, as described below, engagement of the recess wall by the leg 228 prevents opening of the door.

The lower latch mechanism 42 also includes a lower blocking member 240 mounted on the bracket 204 for pivotable movement relative thereto about a horizontal axis 244 between a blocking position (FIG. 10) and a non-blocking position (FIG. 11). The blocking member 240 is U-shaped and has substantially identical spaced apart walls 248 that are arranged generally parallel to and located adjacent and inside the respective bracket walls 208. The blocking member 240 is mounted on a pin 252 that extends along the horizontal axis 244 between the bracket walls 208. When the blocking member 240 is in the blocking position (FIG. 10), each of the walls 248 of the blocking member 240 engages the leg 232 of the lower latch 212 and holds the latch in the locking position, or substantially prevents movement of the lower latch 212 from the locking position toward the non-locking position. However, when the blocking member 240 pivots to the non-blocking position (FIG. 11), the lower latch 212 is free to move to the non-locking position, and the latch will do so because of the force of the spring 224. Each wall 248 of the blocking member 240 defines a slot 256 extending non-radially from the horizontal axis 244.

Figure 8:
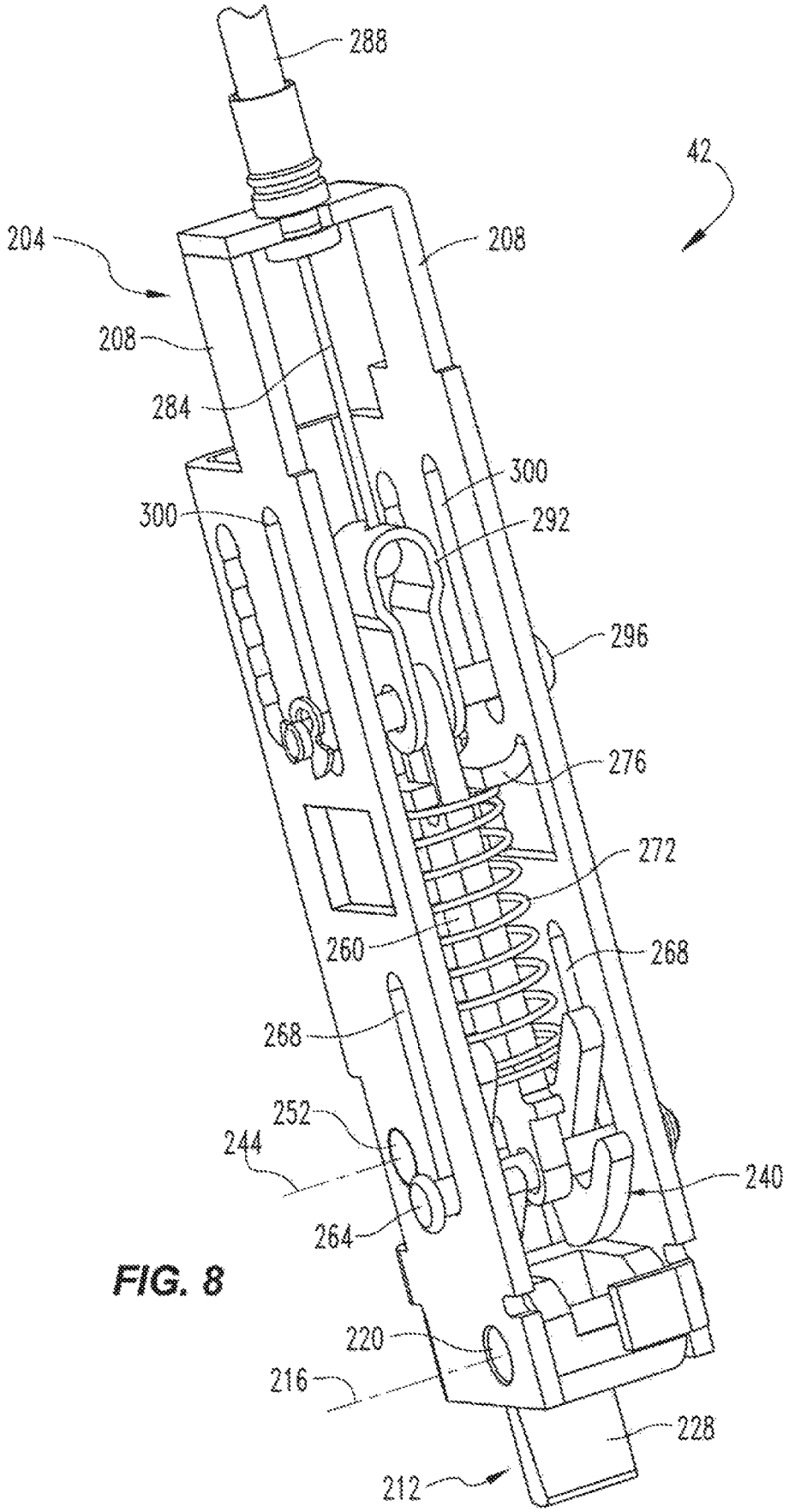
FIG. 8 is a perspective view of the lower latch mechanism of the exit device assembly.
Figure 9:
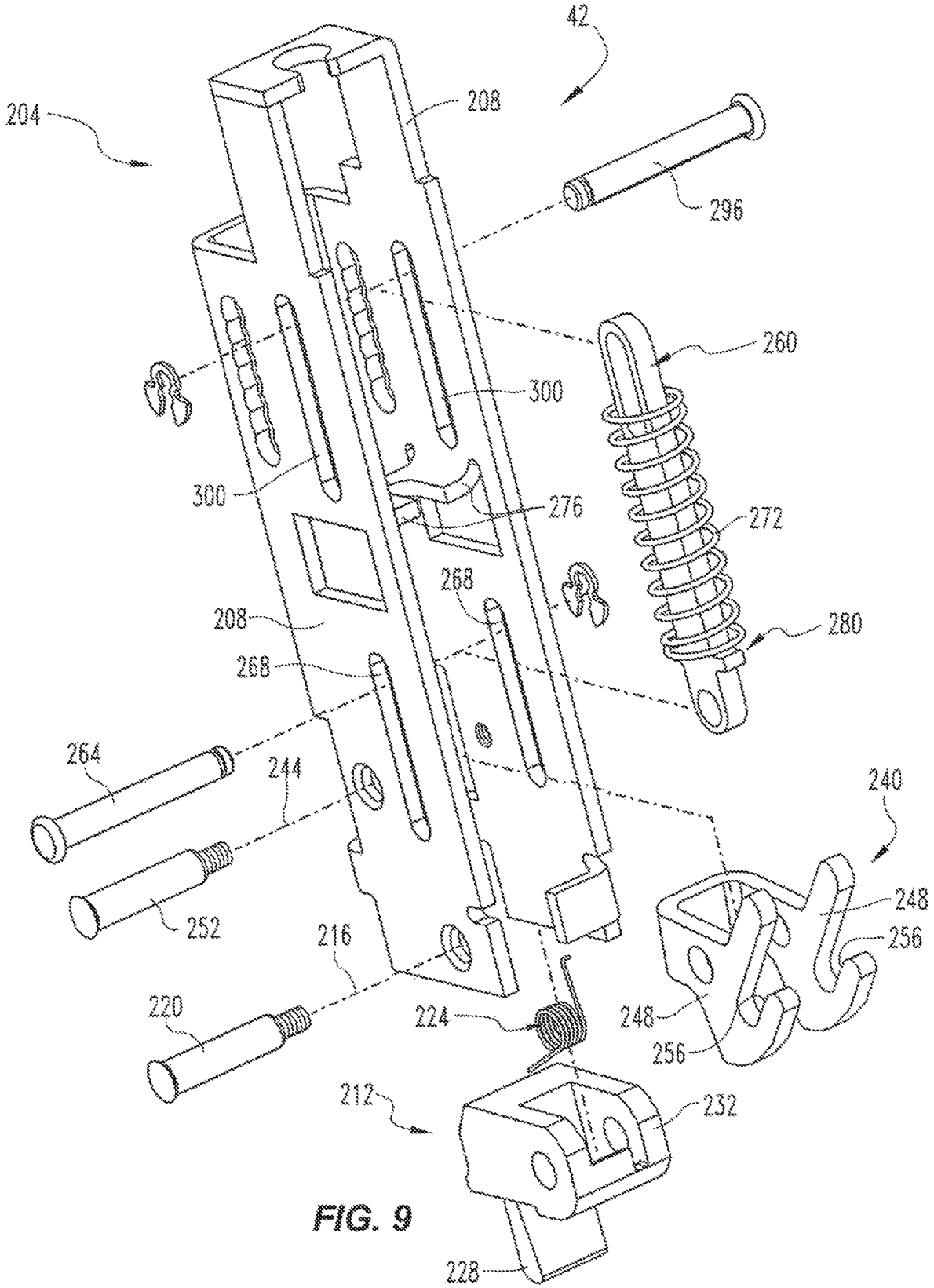
FIG. 9 is an exploded perspective view of the lower latch mechanism.

The lower latch mechanism 42 also includes a rod 260 operably connected to the blocking member 240. As shown in FIG. 8, a pin 264 arranged generally parallel to the horizontal axis 244 is mounted on the lower end of the rod 260, and the pin 264 extends into a pair of slots 256 defined in the blocking member walls 248. The pin 264 also travels in vertical slots 268 in the bracket walls 208 of the bracket 204. In other words, movement of the pin 264 is confined to the slots 268. When the pin 264 is displaced along the slots 268, the pin 264 engages the walls of the blocking member slots 256 and correspondingly pivots the blocking member 240. The pin 264 is movable between an upper position (FIG. 11) and a lower position (FIG. 10). When the pin 264 is in the lower position, the blocking member 240 is in the blocking position. As the pin 264 moves toward the upper position, the pin 264 engages the blocking member 212 and pivots the blocking member 264 to the non-blocking position.

In the illustrated embodiment, the pin 264 correspondingly moves with the rod 260, and the rod 260 is biased downwardly or in a direction which displaces the pin 264 to its lower position. The rod 260 is biased downwardly by a compression spring 272 extending between the bracket 204 and the rod 260. Specifically, the upper end of the spring 272 engages tabs 276 extending inwardly from the bracket walls 208, and the lower end of the spring 272 engages a shoulder 280 defined by the rod 260. The pin 264 moves in an upward direction, or toward its upper position, as the rod 260 moves upwardly against the force of the spring 272. As should be appreciated, movement of the rod 260 is controlled by a cable 284 operably connected to the upper end of the rod 260. In one embodiment, the cable 284 is an enclosed or Bowden cable surrounded by a sheath 288, and a lower end of the sheath 288 is fixed to the bracket 204. The lower end of the cable 284 is operably fixed to the upper end of the rod 260 by a yoke 292 and a pin 296. The pin 296 extends generally parallel to the horizontal axis 216 and travels within vertical slots 300 in the bracket walls 208.

Figure 4:
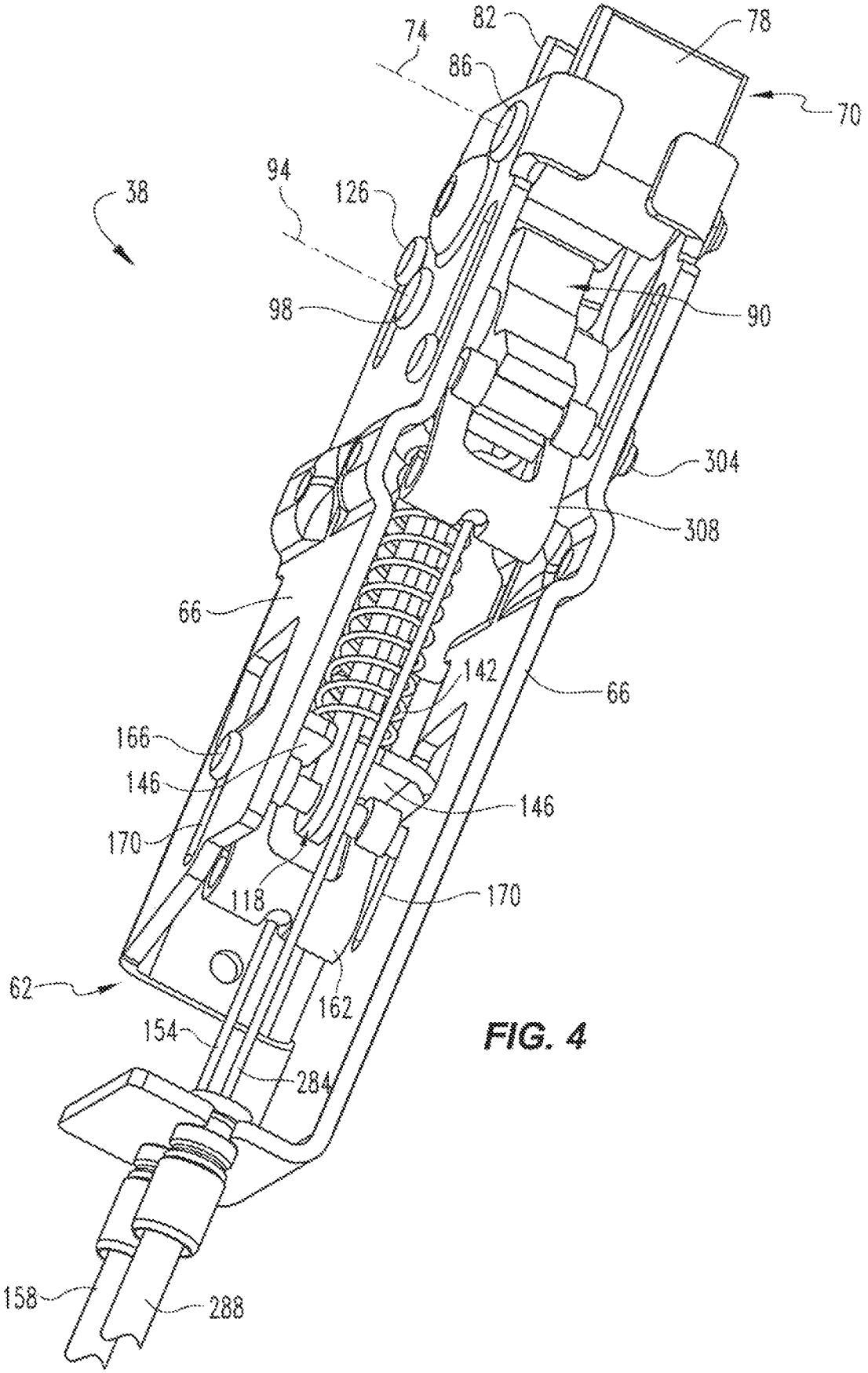
FIG. 4 is another perspective view of the upper latch mechanism.

As shown in FIG. 4, the upper end of the cable 284 is fixed to a pin 304 arranged generally parallel to the horizontal axis 94 of the upper latch mechanism 38. The cable 284 is connected to the pin 304 by a yoke 308. The pin 304 travels in vertical slots 312 in the bracket walls 66, and the pin 304 extends into the slot 114 defined by the upper blocking member 90. The pin 304 is movable between an upper position (FIG. 7) and a lower position (FIG. 6). The pin 304 is in its lower position when the upper blocking member 90 is in its blocking position, and the blocking member 90 moves the pin 304 to its upper position as the blocking member 90 moves to the non-blocking position. Such movement of the pin 304 corresponding pulls on the cable 284, and the cable 284 in turn pulls on the pin 296 and pivots the lower blocking member 240 toward its non-blocking position.

When the door 14 is closed and a user is not pushing on the pushpad 50, the slide member 180 is positioned in its upper position, both blocking members 90 and 240 are in their blocking positions, and both the upper latch 70 and the lower latch 212 are in their locking positions. Additionally, the upper latch 70 engages the strike 54 and the lower latch 212 extends into the recess 58. However, when a user pushes on the pushpad 50, the slide member 180 moves downward and pulls on the cable 154, which in turn pulls downwardly on the rod 118. The rod 118 in turn pulls downward on the pin 126, which pivots the blocking member 90 to its non-blocking position, thereby allowing the upper latch 70 to pivot to its non-locking position. When the upper latch 70 is in the non-locking position, the upper latch 70 engages the blocking member 90 and prevents movement of the blocking member 90 back to the blocking position. Thus, when the user releases the pushpad 50 and the slide member 180 no longer pulls down on the cable 154, the upper latch 70 prevents the blocking member 90 from returning to the blocking position, notwithstanding the force of the spring 142, and the upper latch 70 remains in the non-locking position. As should be appreciated, the upper latch 70 does not return to the locking position until the upper latch 70 engages the strike 54 upon closing of the door, at which time the strike 54 hits the leg 82 of the upper latch 70 and pivots the upper latch 70 to the locking position. This movement of the upper latch 70 thereby permits the blocking member 90 to return to the blocking position.

When the user pushes on the pushpad 50, movement of the upper blocking member 90 to the non-blocking position causes upward movement of the pin 304, which in turn pulls up on the cable 284. The cable 284 in turn pulls up on the pin 264, which pivots the lower blocking member 240 to its non-blocking position, thereby allowing the lower latch 212 to pivot to its non-locking position under the force of the spring 224. The leg 228 of the lower latch 212 is in turn pivoted out of the recess 58 in the floor, thereby allowing opening of the door. The lower latch 212 will remain in its non-locking position until the door closes, primarily because the lower blocking member 240 will be held in its non-blocking position by the upper blocking member 90 which does not return to its non-blocking position until the door closes. However, when the door closes and the upper blocking member 90 returns to its blocking position, the cable 284 is no longer pulled upward, thereby allowing the lower blocking member 240 to return to its blocking position under the force of the spring 272 on the lower rod 260. Movement of the lower blocking member 240 toward its blocking position pushes the lower latch 212 to its locking position, and the latch leg 228 once again extends into the recess 58.

In the illustrated embodiment of the exit device assembly 10, the upper latch mechanism 38 is provided with an anti-bounce feature or arrangement. With some prior art exit devices, a sufficient sudden force exerted on the door, as might be caused by flying debris during a hurricane or other weather events, may cause the latch to "bounce" out of its latched position and thereby allowing the door to inadvertently open. The anti-bounce feature associated with the upper latch mechanism 38 is designed to resist such unintended opening of the door 14.

As should be appreciated, if a sudden force is applied to the door 14 when the door 14 is locked, initial movement of the pin 126 in the slot 130 will only occur in the radial direction. Notably, radial movement of the pin 126 in the slot 130 will not exert any significant force on the walls of the blocking member slot 110, and therefore will not exert any significant torque on the blocking member 90 which would otherwise tend to pivot the blocking member 90 out of its blocking position. The blocking member 90 will therefore keep the upper latch 70 in its locking position. Also, if a person were to use a screwdriver or another device to strike the outside of the upper latch 70, the resultant force would only push the blocking member 90 in the direction away from the non-blocking position (i.e., would maintain the blocking member 90 in the blocking position) because of the orientation of the engaging surfaces 102, 106 on the upper latch 70 and on the blocking member 90 when the blocking member 90 is in the blocking position. More specifically, in this situation, the surfaces 102, 106 would be oriented such that a torque pushing the upper latch 70 toward the non-locking position would exert on the blocking member 90 a torque toward the blocking position, thereby maintaining the upper latch 70 in the locking position.

Figure 12:
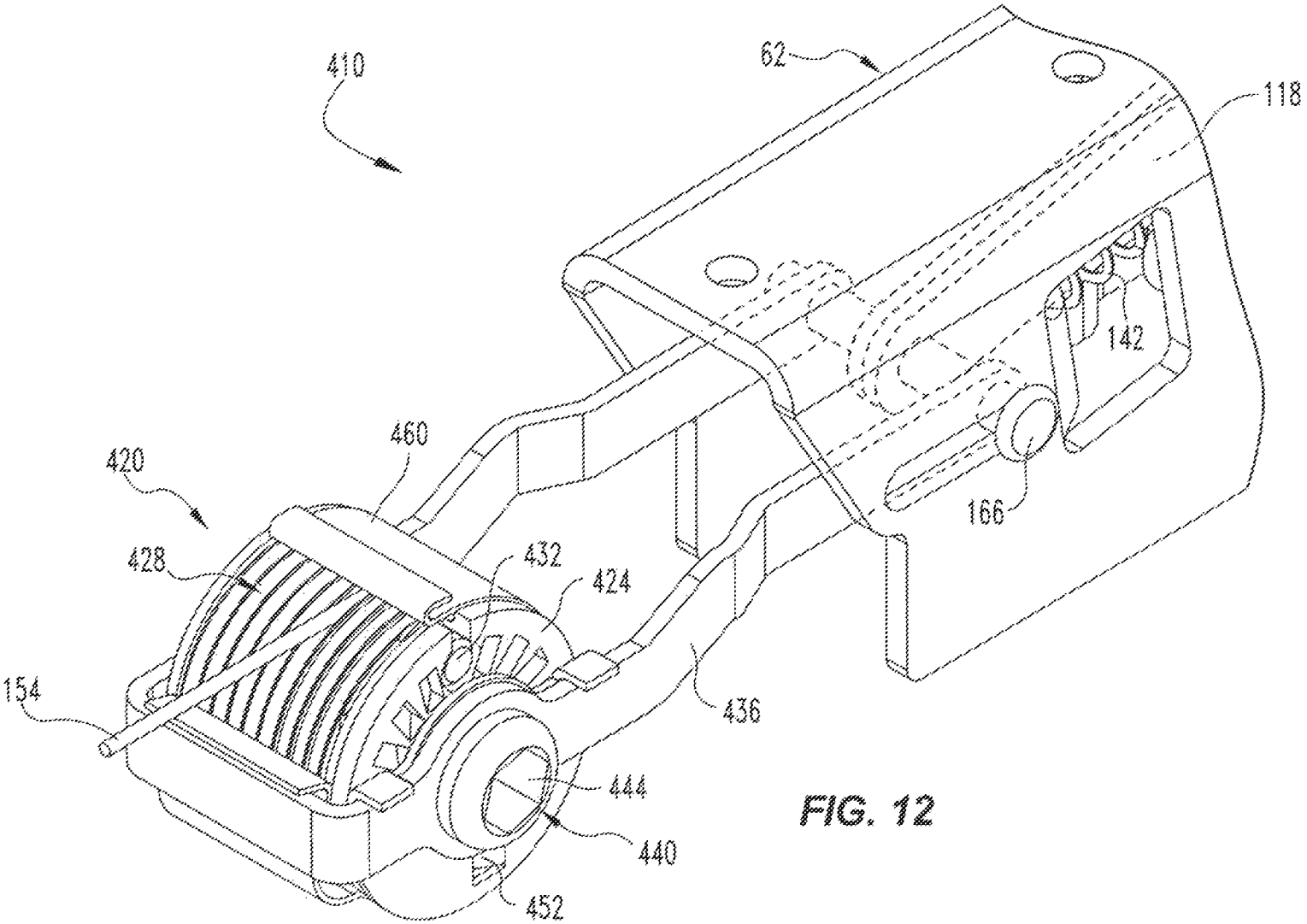
FIG. 12 is a perspective view of a slack removal mechanism for use in association with another embodiment of an exit device assembly.
Figure 13:
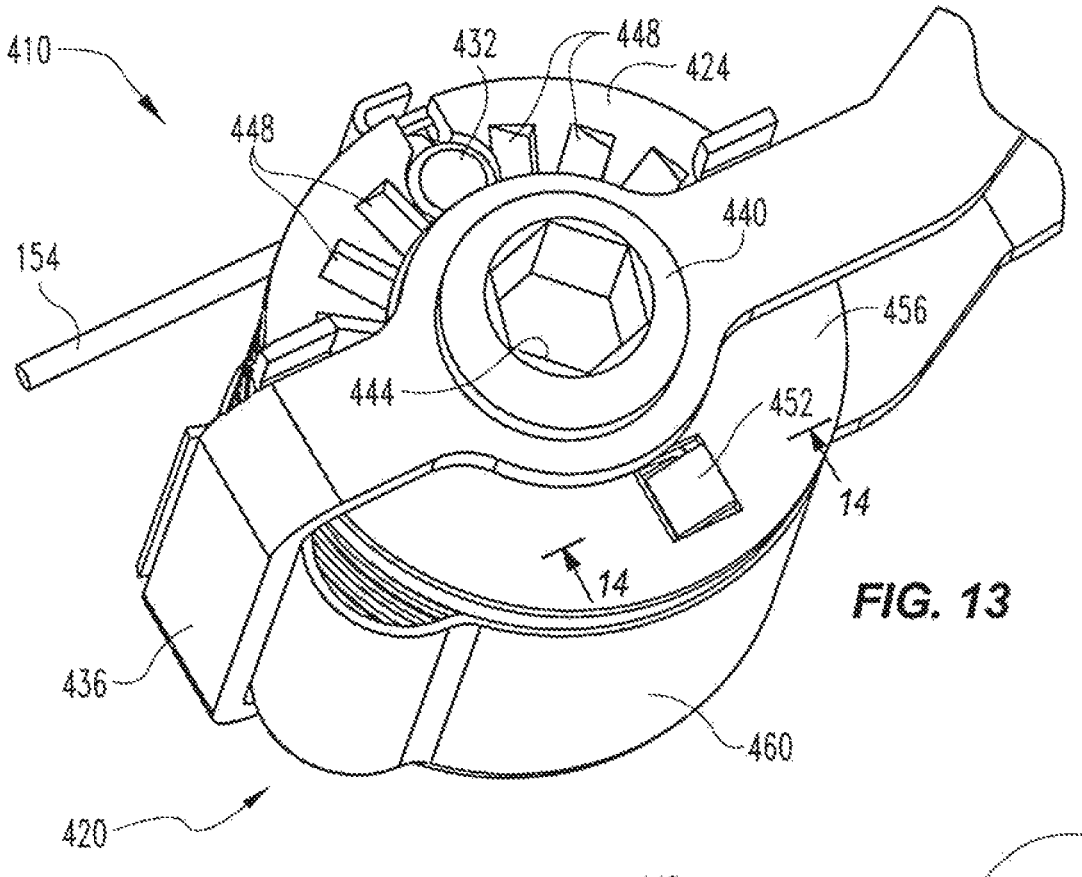
FIG. 13 is a perspective view of a portion of the slack removal mechanism of FIG. 12.
Figure 14:
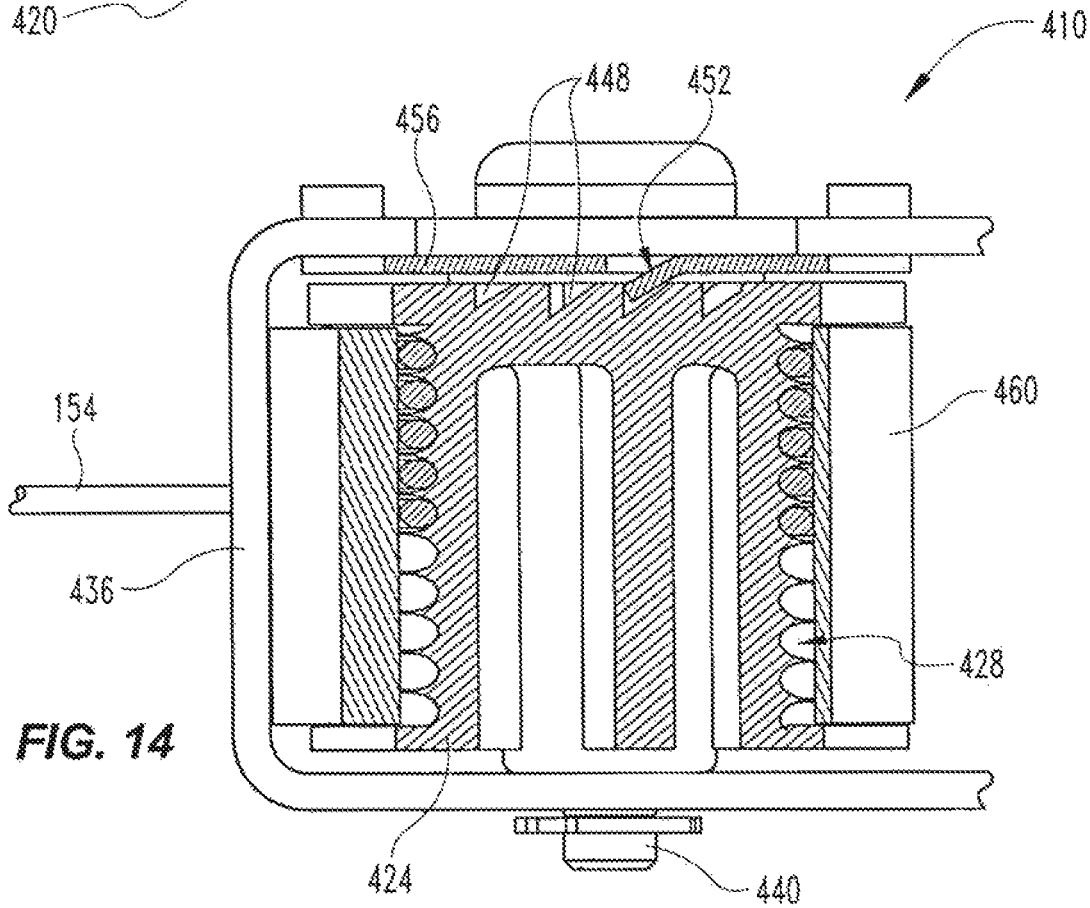
FIG. 14 is a partial sectional view taken along line 14-14 of FIG. 13.

Referring to FIGS. 12-14, shown therein is another embodiment of an exit device assembly 410. Except where indicated below, the exit device assembly 410 is identical to the exit device assembly 10 illustrated and described above, and common elements have been referred to using the same reference numerals. In the illustrated embodiment of the exit device assembly 410, the cable 154 is connected to the upper latch mechanism 38 by a slack removal mechanism 420 which is configured to take up slack in the cable 154. As should be appreciated, this feature allows the exit device assembly 410 to be used on doors 14 of different heights without having to change or modify the length of the cable 154, and likewise allows the position of the slide member 180 on the door 14 to be varied without having to change or modify the length of the cable 154.

In the illustrate embodiment, the mechanism 420 includes a spool 424 around which an end portion of the cable 154 is wound. More particularly, the spool 424 has a generally cylindrical outer surface defining a spiral or helical groove 428. The end of the cable 154 includes a barrel-shaped member 432 fixed thereon which is housed in a pocket in one end of the spool 424. As shown in FIG. 12, the mechanism 420 includes a yoke 436 that is connected to the lower end of the rod 118 by the pin 166, and the spool 424 is fixed to a shaft or pin 440 that is rotatable relative to the yoke 436. The spool 424 can be fixed to the shaft 440 by any suitable means, such as by providing the shaft with a non-circular section seated within a complementary recess or opening in the spool 424. One end of the shaft 440 defines a socket 444 for receiving an Allen wrench or another type of driving tool for rotating the shaft 440 and the spool 424. A ratchet device allows rotation of the spool 424 in a direction that takes up slack in the cable 154 (clockwise in FIG. 13) and which prevents rotation of the spool 424 in the opposite direction (counter clockwise in FIG. 13). In one embodiment, the ratchet device includes a plurality of recesses 448 spaced around the end of the spool 424 such that the recesses define a circle centered on the shaft 440. The ratchet device also includes a pawl 452 fixed relative to the yoke 436. As shown in FIGS. 12 and 13, in one embodiment, the pawl 452 is a flexible tab located on a semi-circular member 456 which is fixed to the yoke 436. The pawl 452 snaps into successive recesses 448 as the spool 424 rotates in one direction, but engages the spool 424 to prevent rotation in the other direction. A protective cover 460 extends over approximately three quarters of the spool 424. With the upper latch mechanism 38 and the slide member 180 mounted on the door 14 with the lower end of the cable 154 connected to the slide member 180 and the upper end of the cable 154 connected to the spool 424, the spool 424 and the shaft 440 are rotated with an Allen wrench or another suitable tool such that the cable 154 winds onto the spool 424. The spool 424 is rotated until slack in the cable 154 is taken up and the cable 154 is pulled to a taut state.

As should be appreciated, the cable 154 constitutes a non-rigid mechanism for causing movement of the upper latch 70 in response to movement of the pushpad 50. As should also be appreciated, the spool 424 can be accessed with the cable 154 installed in the door 14 (i.e., without having to remove the spool 424 or the cable 154), thereby allowing for convenient adjustment of the exit device assembly 10 while the door 14 is mounted to the door frame. As should be further appreciated, the exit device 34 and the upper and lower latch mechanisms 38, 42 are grounded through the cable system. Additionally, the distance between the latch mechanisms 38, 42 and the exit device 34 does not directly affect the functionality of the exit device assembly 10, and interconnection of the exit device 34 and the latch mechanisms 38, 42 does not require a direct line of sight and/or precise alignment, thereby allowing the exit device 34 and the latch mechanisms 38, 42 to have different backsets from the edge of the door 14 and/or from the front/back of the door 14. Furthermore, in view of the flexible and non-rigid nature of the exit device assembly 10 (i.e., the flexibility and non-rigidity provided by the cable system), if the latch mechanisms 38, 42 and/or the exit device 34 are displaced from their installed locations, the exit device assembly 10 does not necessarily require re-adjustment. Instead, the flexible and non-rigid nature of the exit device assembly 10 can alleviate or at least minimize the need for re-adjustment of the latch mechanisms 38, 42 and/or the exit device 34. Moreover, the flexible cable system is easy to install or remove from the door 14, even in instances where the door 14 is installed with a low ceiling clearance. Furthermore, a length of cable can be used for multiple door heights. The cable system also provides for direct attachment of the upper latch mechanism 38 to the lower latch mechanism 42, thereby removing or at least minimizing tolerances from the hold-open function and allowing a cable-based system to control operation of the lower latch mechanism 42. Additionally, concealment of the cable system within the door 14 results in a more aesthetic system, serves to protect the internal components and interconnections, and provides an added degree of security by eliminating potential tapering of the internal components and interconnections.

Figure 15:
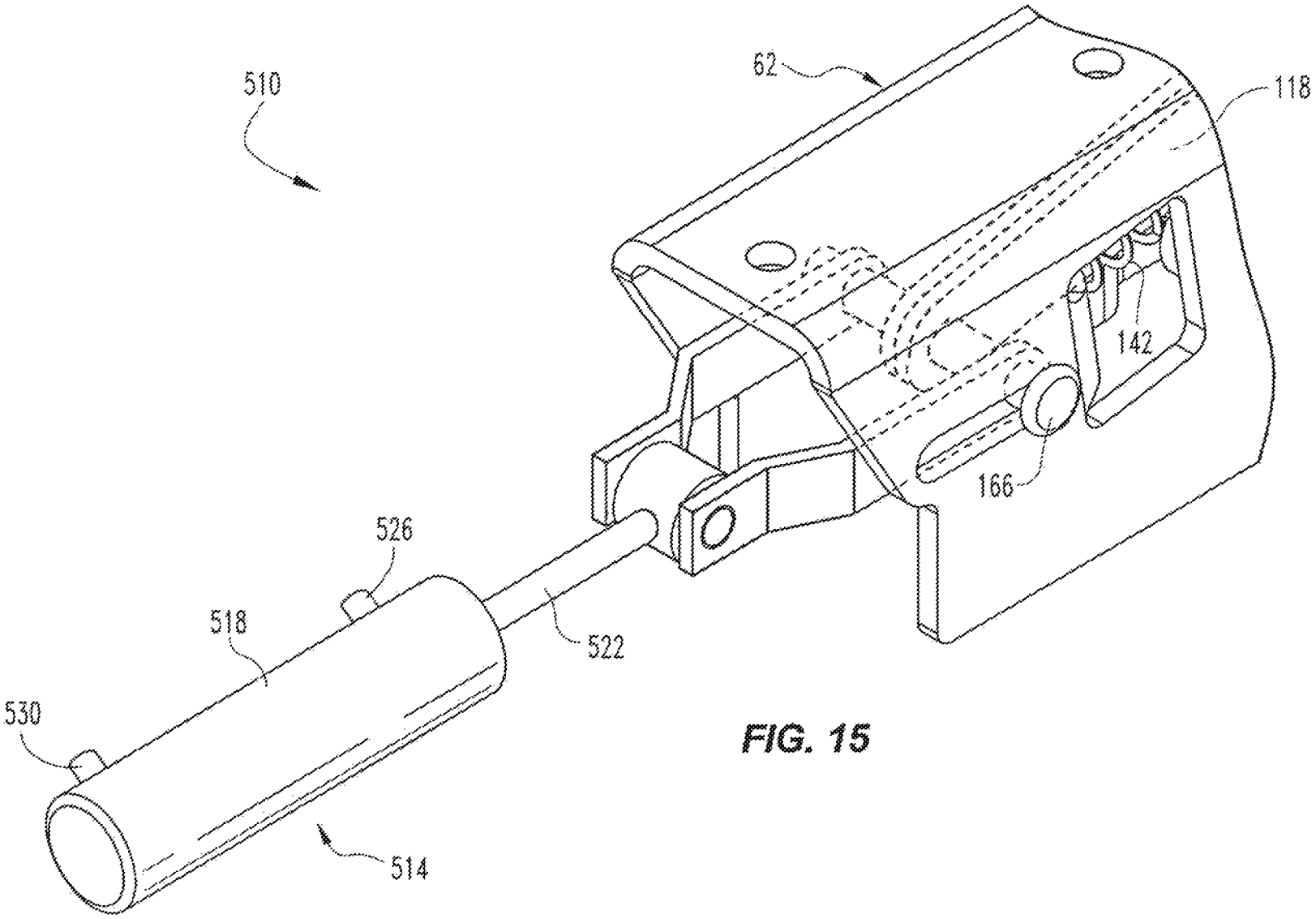
FIG. 15 is a perspective view of a portion of another embodiment of an exit device assembly.
Figure 17:
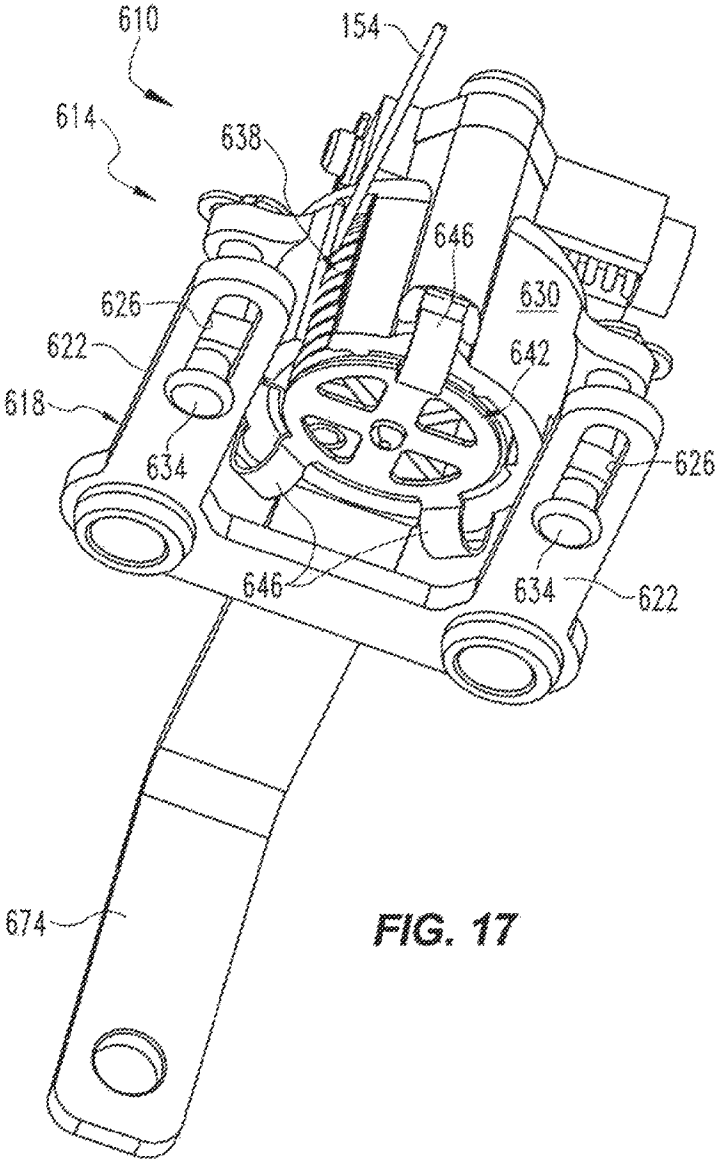
FIG. 17 is another perspective view of the slack removal mechanism of FIG. 16.
Figure 16:
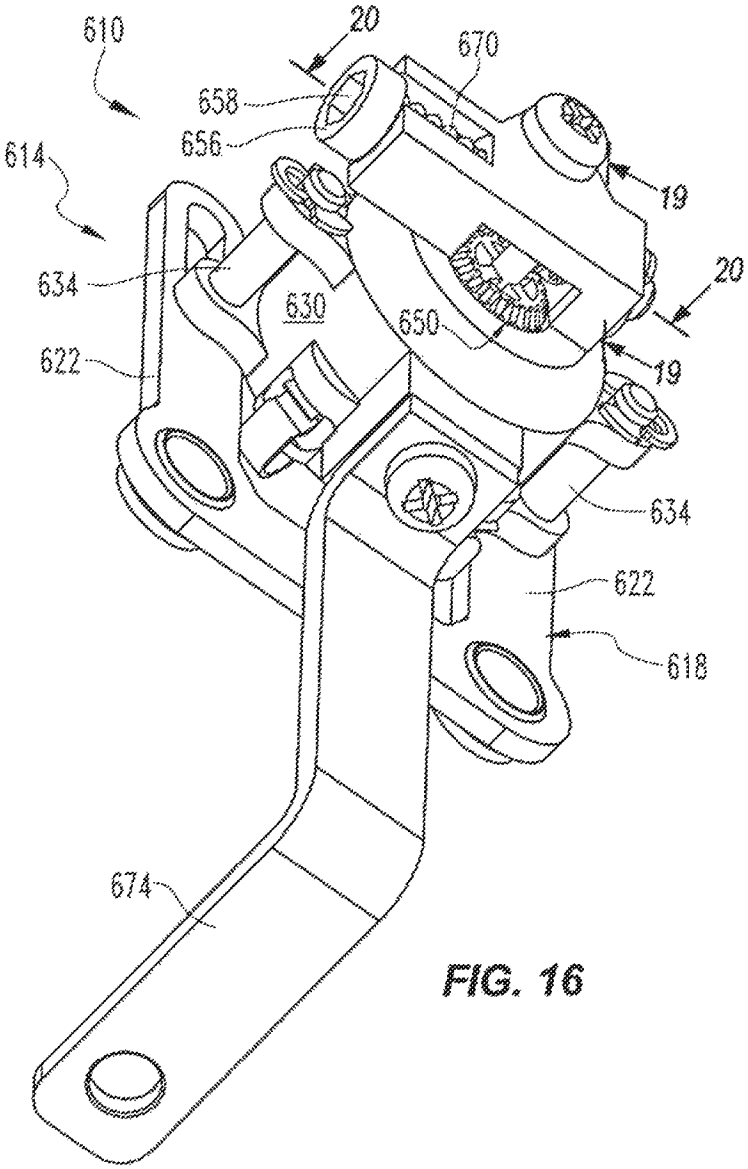
FIG. 16 is a perspective view of a slack removal mechanism for use in association with another embodiment of an exit device assembly.
Figure 18:
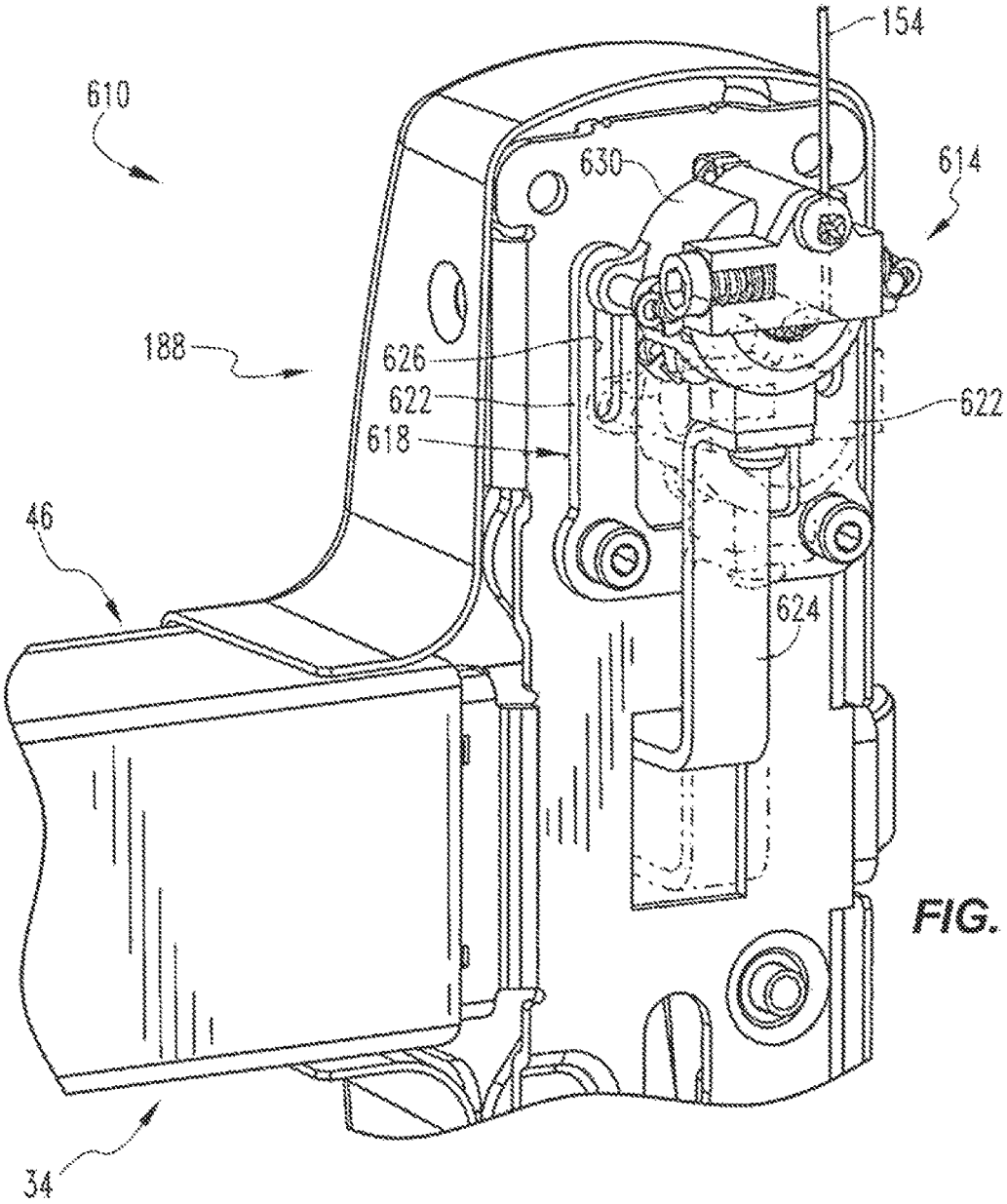
FIG. 18 is an enlarged perspective view of a portion of the exit device assembly used in association with the slack removal mechanism of FIGS. 16 and 17.
Figure 19:
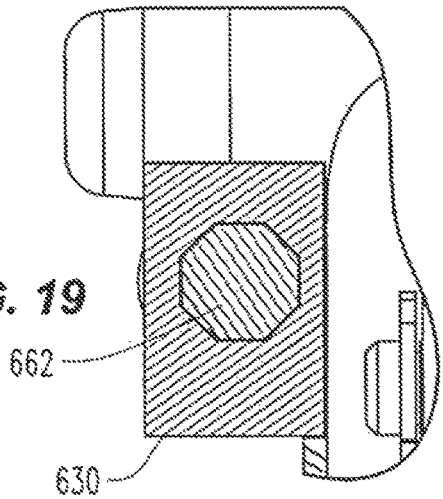
FIG. 19 is a sectional view taken along line 19-19 of FIGS. 16 and 20 with the worm positioned in a first axial position.

Referring to FIG. 15, shown therein is another embodiment of an exit device assembly 510 including a different type of non-rigid mechanism. Except as described below, the exit device assembly 510 is identical to the exit device assembly 10 illustrated and described above, and common elements have been referred to using the same reference numerals. In the illustrated embodiment of the exit device assembly 510, the non-rigid mechanism includes one or more hydraulic cylinder/piston devices 514 (only one is shown in the illustrated embodiment) connected by hydraulic conduits. Each of the hydraulic cylinder/piston devices 514 includes a piston (not shown) and a cylinder 518. The piston rod 522 of the lower device (not shown) is connected to the slide member 180, and the piston rod 522 of the upper device 514 is connected to the lower end of the rod 118. One conduit 526 (partially shown) connects the rod ends of the cylinders, and another conduit 530 (partially shown) connects the other ends of the cylinders. As should be appreciated, downward movement of the lower piston rod causes downward movement of the upper piston rod, and upward movement of the upper rod causes upward movement of the lower rod.

It should be understood that other types of non-rigid mechanisms such as, for example, rotary cables, could be used to connect the exit device 34 to the upper and lower latch mechanisms 38, 42. It should also be understood that the latch mechanisms 38, 42 could be actuated by non-rigid devices that are not entirely mechanical (i.e., electrical devices or electro-mechanical devices). For example, the latch mechanisms 38, 42 could be actuated by solenoids or stepper motors that are remote from the centercase 188 (i.e., like the hydraulic device 514 in FIG. 15) and which are connected to a control unit in the centercase 188 or at another location either with wires or wirelessly.

Referring to FIGS. 16-21, shown therein is another embodiment of an exit device assembly 610. Except as described below, the exit device assembly 610 is identical to the exit device assembly 10 illustrated and described above, and common elements have been referred to using the same reference numerals. As specifically illustrated in FIG. 18, in the exit device assembly 610, a slack removal mechanism 614 is connected to the lower end of the cable 154. The slack removal mechanism 614 includes a U-shaped mounting bracket 618 fixed to the centercase 188 of the pushpad mechanism 46 of the exit device 34. The bracket 618 has spaced legs 622, with each leg 622 defining therein a vertical slot 626. A spool casing 630 is mounted on the bracket 618 for movement relative thereto between upper and lower positions. The casing 630 is mounted on the bracket 618 with pins 634 that extend through respective ones of the vertical slots 626. The casing 630 supports a spool 638 (FIG. 17) for rotation relative to the casing 630 about a horizontal axis, with the lower end of the cable 154 wound around the spool 638. The spool 638 is removably held in the casing 630 via a spring clip 642 (FIG. 17) having three arms 646 that slide into respective grooves in the casing 630.

Figure 20:
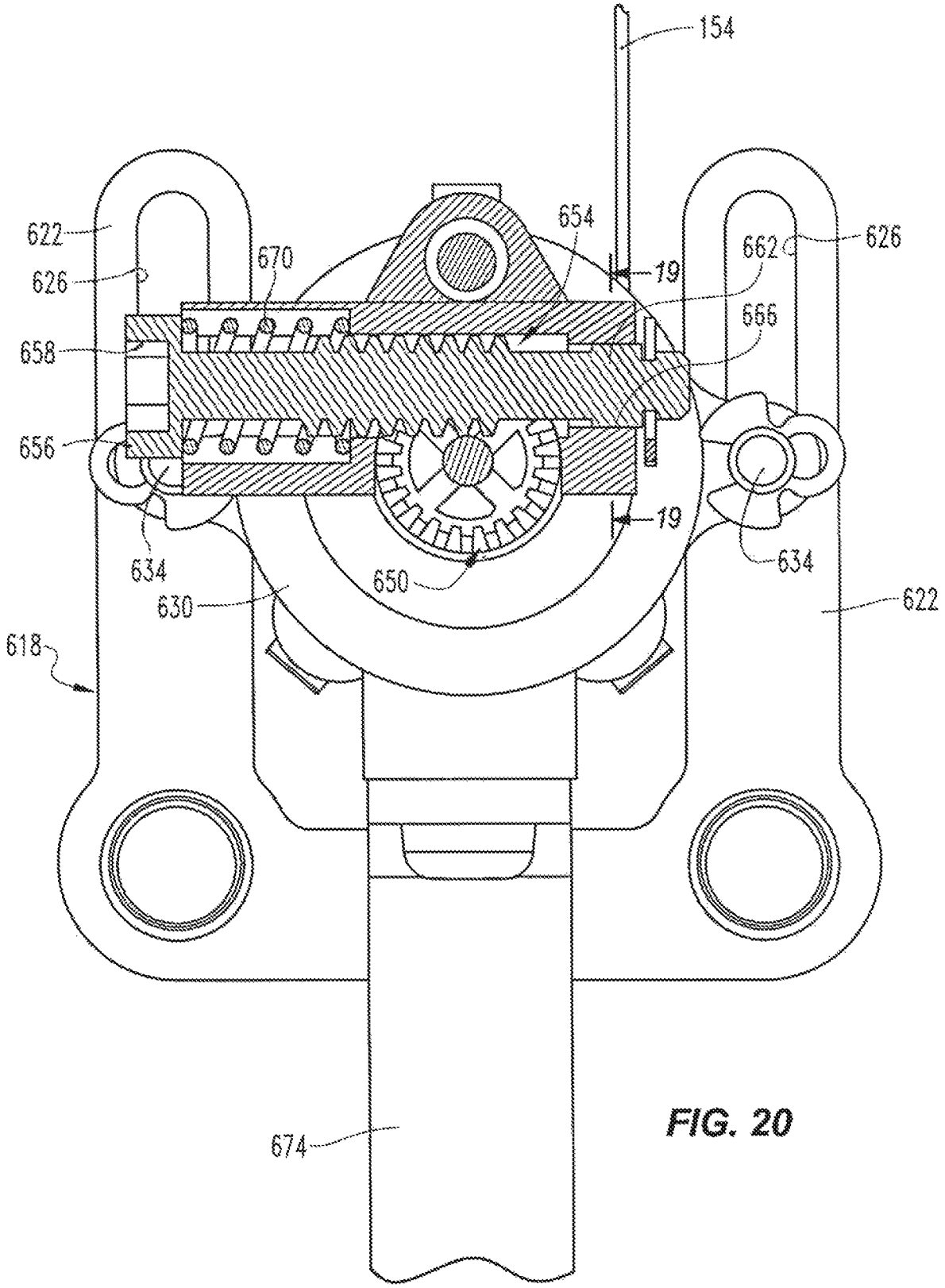
FIG. 20 is a sectional view taken along line 20-20 of FIG. 16 with the worm positioned in the first axial position.
Figure 21:
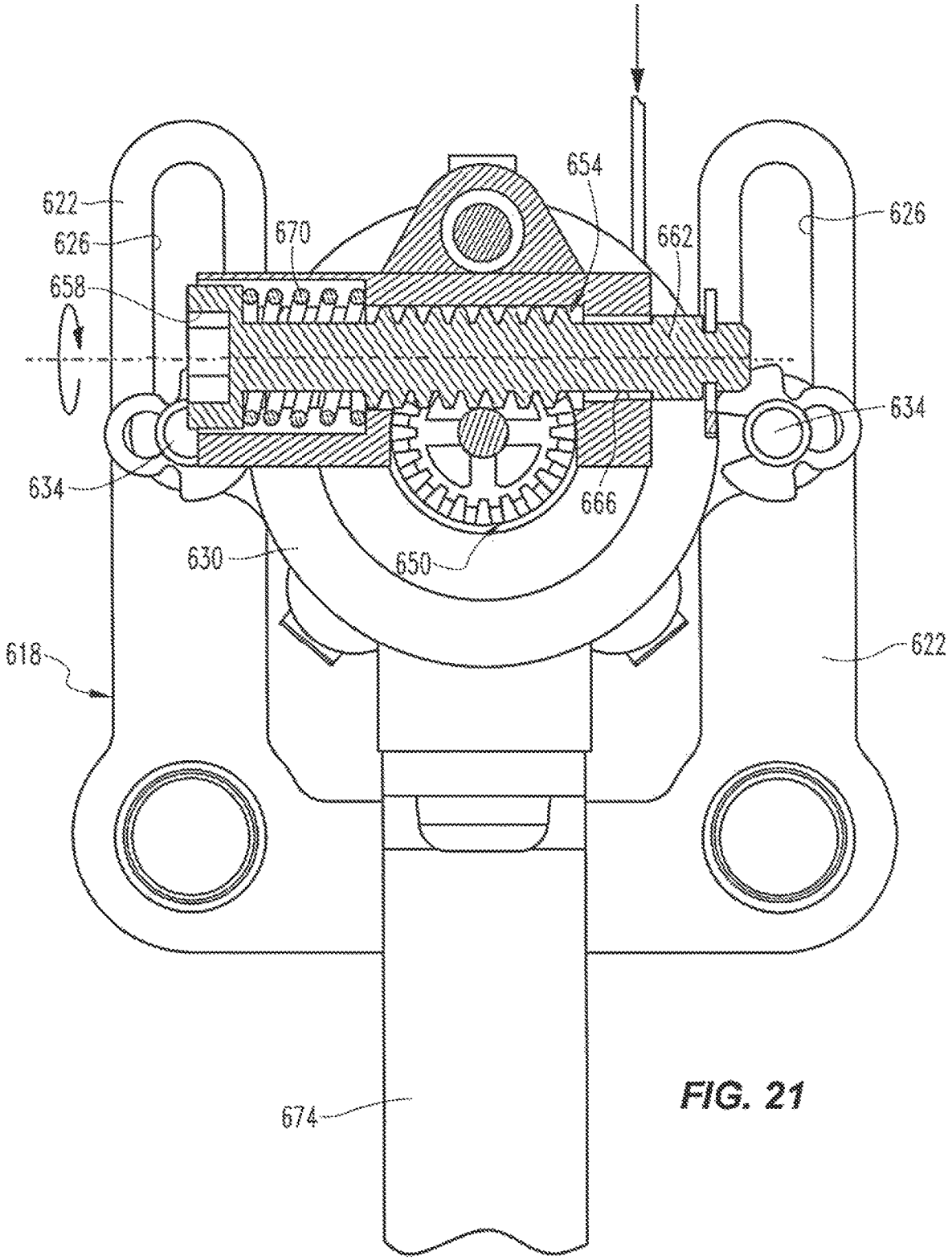
FIG. 21 is view similar to FIG. 20 with the worm positioned in a second axial position.

In the illustrated embodiment of the exit device assembly 610, a worm gear arrangement is mounted on one end of the casing 630. The gear arrangement includes a worm gear 650 fixed to an end of the spool 638, and a worm screw 654 (FIGS. 20 and 21) intermeshingly engaging the worm gear 650. As should be appreciated, rotation of the worm screw 654 in one direction correspondingly rotates the spool 638 in one direction, and rotation of the worm screw 654 in the opposite direction correspondingly rotates the spool in the opposite direction. The worm screw 654 has a head 656 with a socket 658 for receiving an Allen wrench or another type of drive tool. As shown in FIGS. 20 and 21, the worm screw 654 is movable axially (left-to-right in FIGS. 20 and 21) relative to the casing 630. When the worm screw 654 is in a locked axial position (FIGS. 19 and 20), a hexagonal end part 662 of the worm (the end opposite the head) is seated in a complementary recess 666 in the casing 630 so that the worm screw 654 cannot rotate relative to the casing 630. Because the worm screw 654 engages the worm gear 650, the worm gear 650 and the spool 638 cannot rotate when the worm screw 654 is in the locked position. The worm screw 654 is biased to the locked position by a spring 670 extending between the casing and the head 656 of the worm screw 654. In order to rotate the worm screw 654 and thereby the spool 638, a user pushes the head 656 of the worm screw 654 inward, against the force of the spring 670, to an unlocked position (FIG. 21) in which the hexagonal end portion 662 of the worm screw 654 is positioned outside of the recess 666. The worm screw 654 can then be rotated in either direction to wind the cable 154 onto or off of the spool 638.

In the illustrated embodiment, an L-shaped connecting member 674 connects the spool casing 630 to the pushpad mechanism 46 such that the spool 638 moves from the upper position to the lower position when the pushpad 50 is pushed in, and moves from the lower position to the upper position when the pushpad 50 is released. As should be appreciated, downward movement of the spool 638 pulls down on the cable 154 to operate the upper latch mechanism 38.

Figure 22:
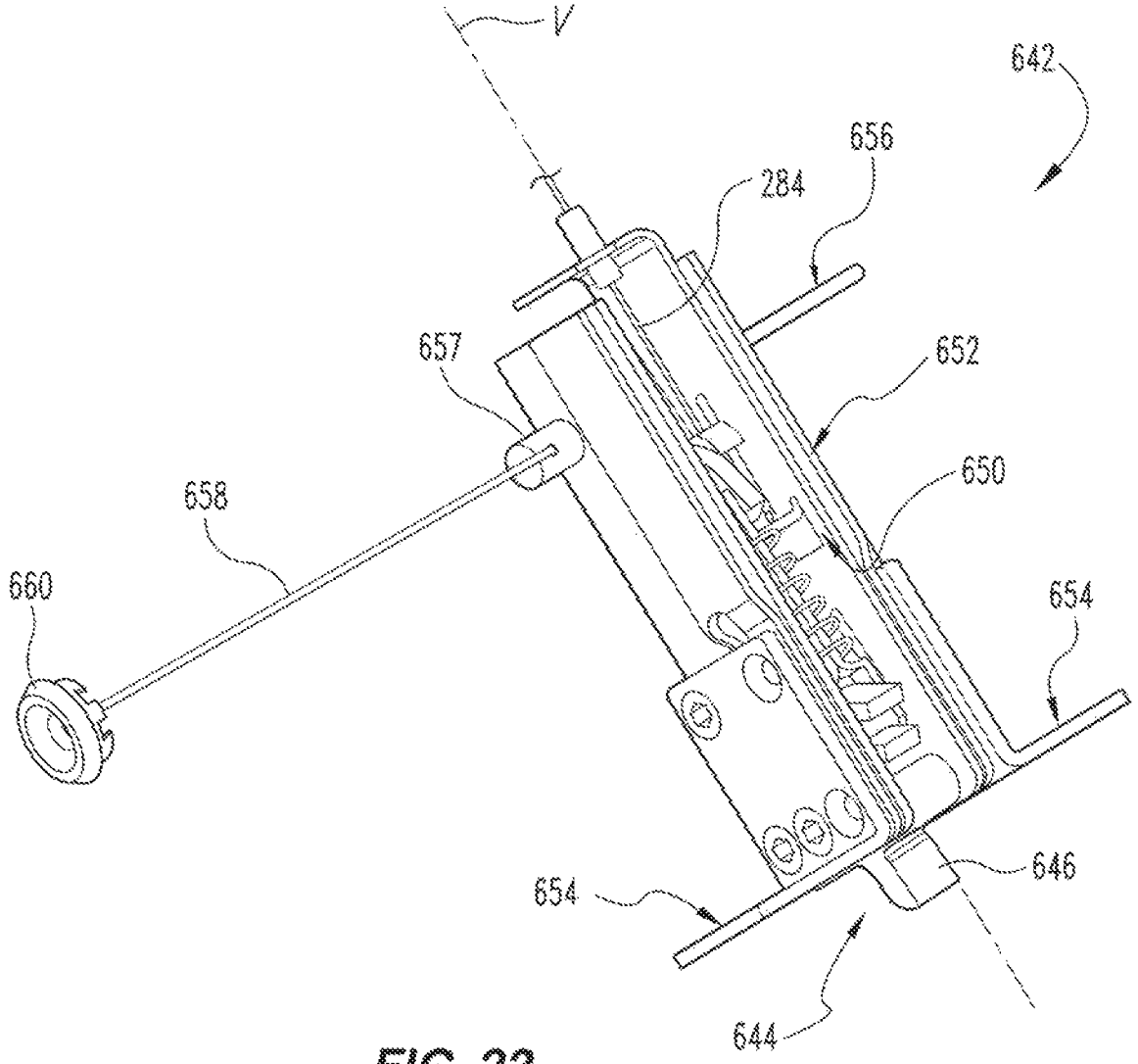
FIG. 22 is an illustrative view of one embodiment of an adjustable height latch.

Referring to FIG. 22, shown therein is one embodiment of an adjustable latch mechanism 642 for mounting to the door 14. In one embodiment, the adjustable latch mechanism 642 may be mounted to the door 14 adjacent the bottom 26, and more specifically adjacent the recess 58 in the floor or door frame (FIG. 1). However, in other embodiments, the adjustable latch mechanism 642 may be mounted adjacent other regions of the door 14 including the top 22 of the door adjacent the strike 54.

In one embodiment, the adjustable latch mechanism 642 is configured similar to the lower latch mechanism 42 illustrated and described above, and is configured to operate in a manner similar to the lower latch mechanism 42. Specifically, in one embodiment, the adjustable latch mechanism 642 may be provided with many of the same elements and features found in the lower latch mechanism 42, and may be engaged with the cable 284 in a manner similar to that illustrated in FIG. 8 such that pulling the cable 284 correspondingly pivots the lower latch 644 from a locking position (illustrated in FIG. 22) to a non-locking position. As should be appreciated, in the locking position, the leg 646 of the lower latch 644 extends into the recess 58 in the floor or door frame (i.e., FIG. 10) to maintain the door 14 in a closed position. However, exertion of a pulling force onto the cable 284 (i.e., via exertion of a pushing force onto the pushpad 50) pivots the lower latch 644 to a non-locking position (i.e., FIG. 11) wherein the leg 646 of the lower latch 644 is disengaged from the recess 58 to allow opening of the door 14. Although the adjustable latch mechanism 642 has been illustrated and described as being configured for use in association with the recess 58, it should be understood that the adjustable latch mechanism 642 may be configured for use in association with other elements and device such as, for example, the strike 54.

The adjustable latch mechanism 642 is mounted to the door 14 and is configured to allow an installer to variably adjust the vertical height or position of the lower latch 644 on the door 14. As should be appreciated, this adjustability allows for fine tuning of the vertical position of the lower latch 644 relative to the recess 58. In one embodiment, the adjustable latch mechanism 642 includes a base or carrier member 650 that is selectively moveable relative to a body or mount member 652. Additionally, a number of angled brackets or anchor devices 654 may be used to secure the mount member 652 to the door 14. In the illustrated embodiment, the carrier member 650 is moveable relative to the mount member 652 in a direction generally along a vertical axis V, and the carrier member 650 can be locked into a select vertical position relative to the mount member 652 via engagement of a locking pin 656 with one of a plurality of discrete locking locations along the vertical axis V. In one embodiment, the locking pin 656 may be positioned in aligned openings or apertures defined by the carrier member 650 and the mount member 652 to lock the carrier member 650 (and the lower latch 644) in a generally stationary position relative to the mount member 652. Specifically, the carrier member 650 may be provided with a plurality of openings or apertures (not shown) that are spaced from one another along the vertical axis V, and the mount member 652 may be provided with at least one opening or aperture that is selectively alignable with one of the openings in the carrier member 650 for receipt of the locking pin 656 through the aligned openings to thereby selectively lock the carrier member 650 (and the lower latch 644) in a generally stationary position relative to the mount member 652 (and the recess 58).

In one embodiment, a flexible cable or tether 658 may be attached to an end portion or head 657 of the locking pin 656. The tether 658 terminates in an enlarged end portion or cap 660. As should be appreciated, the tether 658 may extend toward a vertical edge of the door 14 with the cap 660 positioned adjacent the vertical edge. If adjustment to the vertical position of the carrier member 650 relative to the mount member 652 is required, the installer may pull on the cap 660 to disengage the locking pin 656 from the carrier member 650 and/or the mount member 652 to thereby permit vertical adjustment of the height of the carrier member 650 (and the lower latch 644) relative to the mount member 652 (and the recess 58). In this manner, the vertical position of the carrier member 650 relative to the mount member 652 can be easily and conveniently adjusted without having to remove the adjustable latch mechanism 642 from the door 14. Additionally, the locking pin 656 may be provided with a spring or another type of biasing member (not shown) configured to bias the locking pin 656 back into engagement with aligned openings in the carrier member 650 and the mount member 652 upon removal of the pulling force from the tether 658 to once again lock the carrier member 650 in a select vertical position relative to the mount member 652.

It should be understood that other devices and techniques for varying the vertical position of the carrier member 650 relative to the mount member 652 and/or for locking the carrier member 650 in a select vertical position relative to the mount member 652 are also contemplated. For example, in another embodiment, the adjustable latch mechanism 642 may include an continuous adjustment mechanism such as, for example, a gear train that allows for continuous variability or adjustment to the height of the carrier member 650 relative to the mount member 652. In another embodiment, a rack and pinion arrangement may be used to provide variable adjustment of the height of the carrier member 650 relative to the mount member 652. Additionally, it should be understood that other suitable mechanisms and techniques are also contemplated for providing variable adjustment of the height of the carrier member 650 relative to the mount member 652.

Various features and advantages of the present invention are set forth in the following claims. Additionally, changes and modifications to the described embodiments described herein will be apparent to those skilled in the art, and such changes and modifications can be made without departing from the spirit and scope of the present invention and without diminishing its intended advantages. While the present invention has been illustrated and described in detail in the drawings and foregoing description, the same is to be considered illustrative and not restrictive in character, it being understood that only selected embodiments have been shown and described and that all changes, equivalents, and modifications that come within the scope of the inventions described herein or defined by the following claims are desired to be protected.

The invention claimed is:

1. An exit device assembly for use with a door having a top, a bottom and a generally vertical surface, the exit device assembly comprising:

an exit device configured to be mounted on the vertical surface of the door, the exit device including a manually movable member;

a latch mechanism configured to be mounted adjacent one of the top and the bottom of the door, the latch mechanism including a latch movable between a locking position and a non-locking position;

a cable for causing movement of the latch in response to movement of the manually movable member; and a slack removal mechanism connected to the cable;

wherein the slack removal mechanism is operably connected with the manually movable member such that movement of the manually movable member causes movement of the slack removal mechanism in a first manner to actuate the latch; and wherein the slack removal mechanism is independently movable in a second manner distinct from the first manner to remove slack in the cable;

wherein movement of the slack removal mechanism in the first manner comprises translation of the slack removal mechanism; and wherein movement of the slack removal mechanism in the second manner comprises rotation of a spool of the slack removal mechanism.

2. The exit device assembly of claim 1 wherein the slack removal mechanism includes a spool around which an end portion of the cable is wound.

3. The exit device assembly of claim 2 wherein the spool is operably connected to the latch and is connected to an end of the cable proximate the latch.

4. The exit device assembly of claim 2 wherein the spool is movable in response to movement of the manually movable member and is connected to an end of the cable remote from the latch.

5. The exit device assembly of claim 2 wherein the slack removal mechanism includes a ratchet device allowing rotation of the spool in a direction taking up slack in the cable and preventing rotation of the spool in the opposite direction.

6. The exit device assembly of claim 2 wherein the slack removal mechanism includes a gear arrangement.

7. The exit device assembly of claim 6 wherein gear arrangement allows rotation of the spool in opposite directions.

8. An exit device assembly for use with a door having a top, a bottom and a generally vertical surface, the exit device assembly comprising:

an exit device configured to be mounted on the vertical surface of the door, the exit device including a manually movable member;

a latch mechanism configured to be mounted adjacent one of the top and the bottom of the door, the latch mechanism having an actuated state and a deactuated state;

a cable connected between the manually movable member and the latch mechanism; and a slack removal mechanism connected with the cable, the slack removal mechanism having an adjustment motion in which the slack removal mechanism adjusts a slack in the cable, and an independent driving motion in which the slack removal mechanism moves with the cable;

wherein the slack removal mechanism is operably connected with the manually movable member and is configured to move in the driving motion in response to movement of the manually movable member; and wherein the latch mechanism is configured to move between the actuated state and the deactuated state in response to the driving motion of the slack removal mechanism and the corresponding movement of the cable.

9. The exit device assembly of claim 8, wherein the slack removal mechanism comprises a yoke and a spool rotatably mounted to the yoke, wherein the adjustment motion comprises rotation of the spool relative to the yoke, and wherein the driving motion comprises joint movement of the yoke and the spool.

10. The exit device assembly of claim 9, wherein an end portion of the cable is wrapped around the spool and has a length; wherein rotation of the spool in a first direction increases the length of the end portion that is wrapped around the spool, thereby decreasing the slack in the cable; and wherein rotation of the spool in an opposite second direction decreases the length of the end portion that is wrapped around the spool, thereby increasing the slack in the cable.

11. The exit device assembly of claim 10, wherein the slack removal mechanism further comprises a ratchet mechanism, the ratchet mechanism permitting rotation of the spool in the first direction and inhibiting rotation of the spool in the second direction.

12. The exit device assembly of claim 10, wherein the slack removal mechanism comprises a gear arrangement allowing rotation of the spool in each of the first direction and the second direction.

13. The exit device assembly of claim 12, wherein the gear arrangement comprises a first gear rotationally coupled with the spool and a worm screw engaged with the first gear, the worm screw including a socket operable to receive a tool for rotating the worm screw.

14. The exit device assembly of claim 9, wherein the exit device further comprises a slide member mounted proximate an end of the exit device, wherein the exit device is configured to translate horizontal movement of the manually movable member to vertical movement of the slide member, and wherein the cable is connected between the slide member and the latch mechanism.

15. The exit device assembly of claim 14, wherein the slack removal mechanism is mounted to the slide member.

16. The exit device assembly of claim 14, wherein the slack removal mechanism is connected between the cable and the latch mechanism, and wherein the cable is connected between the slide member and the slack removal mechanism such that the slack removal mechanism is operably connected with the manually movable member via the cable and the slide member.

17. An exit device assembly, comprising:

a manually movable pushbar;

a slide member operably connected with the pushbar;

a latch mechanism having an actuated state and a deactuated state;

a cable connected between the latch mechanism and the slide member; and a slack removal mechanism comprising a spool, wherein the cable includes a portion that is wrapped around the spool, and wherein rotation of the spool in a first rotational direction increases a length of the portion that is wrapped around the spool, thereby removing slack from the cable;

wherein the slide member is configured to translate the cable and the slack removal mechanism in response to movement of the pushbar; and wherein the latch mechanism is configured to move between the actuated state and the deactuated state in response to translation of the cable and the slack removal mechanism.

18. The exit device assembly of claim 17, wherein the adjustment mechanism further comprises a gear arrangement allowing rotation of the spool in each of the first rotational direction and an opposite second rotational direction, wherein the gear arrangement comprises a first gear rotationally coupled with the spool and a worm screw engaged with the first gear, and wherein the worm screw includes a socket operable to receive a tool for rotating the worm screw.

19. The exit device assembly of claim 17, wherein the spool comprises a helical groove, and wherein the portion of the cable that is wrapped around the spool is seated in the helical groove.

20. The exit device assembly of claim 17, wherein the slack removal mechanism is mounted to the slide member, wherein the cable includes a first end portion and an opposite second end portion, wherein the first end portion includes the portion that is wrapped around the spool, and wherein the second end portion is engaged with the latch mechanism.

21. The exit device assembly of claim 8, wherein the adjustment motion and the driving motion are independent of one another such that the slack removal mechanism is operable to perform the adjustment motion without performing the driving motion, and to perform the driving motion without performing the adjustment motion.

22. The exit device assembly of claim 8, wherein the driving motion comprises linear movement of the slack removal assembly; and wherein the adjustment motion comprises rotation of a spool of the slack removal assembly.

* * * * *